US011105334B2

(12) United States Patent
Craft et al.

(10) Patent No.: US 11,105,334 B2
(45) Date of Patent: Aug. 31, 2021

(54) DUAL VOLUTE COOLANT PUMP

(71) Applicant: Ford Global Technologies, LLC, Dearborn, MI (US)

(72) Inventors: Justin Craft, Royal Oak, MI (US); William Michael Sanderson, Ypsilanti, MI (US); Timothy Comer, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 188 days.

(21) Appl. No.: 16/416,103

(22) Filed: May 17, 2019

(65) Prior Publication Data

US 2020/0362875 A1 Nov. 19, 2020

(51) Int. Cl.

| | |
|---|---|
| ***F04D 29/10*** | (2006.01) |
| ***F04D 29/58*** | (2006.01) |
| ***F01P 5/10*** | (2006.01) |
| ***F01P 3/02*** | (2006.01) |

(52) U.S. Cl.

CPC ..... *F04D 29/106* (2013.01); *F01P 3/02* (2013.01); *F01P 5/10* (2013.01); *F04D 29/586* (2013.01)

(58) Field of Classification Search

CPC ... B63H 21/383; F04D 29/628; F04D 29/586; F04D 29/4293; F04D 29/4273; F04D 29/426; F04D 29/4246; F04D 29/406; F04D 29/2266; F04D 29/167; F04D 29/106; F04D 29/061; F04D 13/021; F04D 29/128; F04D 29/126; F01P 5/10; F01P 3/02

USPC ..... 415/1

See application file for complete search history.

(56) References Cited

U.S. PATENT DOCUMENTS

| | | | | |
|---|---|---|---|---|
| 2,623,466 | A | 12/1952 | Tinker | |
| 3,076,412 | A * | 2/1963 | Harker | F04D 29/2266 415/170.1 |
| 3,416,456 | A | 12/1968 | Pollak et al. | |
| 5,195,867 | A * | 3/1993 | Stirling | F04D 29/061 415/111 |
| 5,489,187 | A | 2/1996 | Ray | |
| 9,254,905 | B1 * | 2/2016 | Randolph | F04D 13/021 |
| 2003/0175118 | A1 * | 9/2003 | Chujo | F01P 5/10 415/206 |
| 2006/0165523 | A1 * | 7/2006 | Rozario | F04D 29/126 415/206 |
| 2014/0030086 | A1 * | 1/2014 | Staley | F04D 29/167 415/208.1 |
| 2017/0009777 | A1 | 1/2017 | Krug | |
| 2017/0027405 | A1 | 2/2017 | Li et al. | |
| 2017/0138367 | A1 | 5/2017 | Garvin et al. | |
| 2020/0362875 | A1 * | 11/2020 | Craft | F04D 29/106 |

FOREIGN PATENT DOCUMENTS

| | | | | |
|---|---|---|---|---|
| CN | 101038000 A * | 9/2007 | | F04D 29/128 |

* cited by examiner

*Primary Examiner* — J. Todd Newton

(74) *Attorney, Agent, or Firm* — Geoffrey Brumbaugh; McCoy Russell LLP

(57) ABSTRACT

Methods and systems are provided for a coolant pump. In one example, the coolant pump may be a dual-volute coolant pump with an impeller driving circulation of coolant through the pump and a seal disposed around a shaft of the impeller. A set of anti-vortex structures may be arranged within an inner chamber of the pump, the structures generating a pressure differential in the inner chamber that drives a cross-flow of coolant, thereby convectively cooling the seal.

19 Claims, 11 Drawing Sheets

DUAL VOLUTE COOLANT PUMP

FIELD

The present description relates generally to a coolant pump.

BACKGROUND/SUMMARY

Efficient circulation of a coolant through an engine system may mitigate overheating and resulting degradation of engine components that may interrupt engine operation and shorten a lifetime of the components. By flowing the coolant through channels or compartments of a cooling system in contact with the components, heat may be transferred from the engine system to the coolant, thereby absorbing thermal energy from the components. The coolant flow may be driven by a pump that may be mechanically operated by an engine crankshaft or another rotating component. In some examples, the pump used with the cooling system may be a centrifugal pump that includes an impeller within the pump chamber to drive fluid motion.

The pump may be configured with an impeller shaft seal that is disposed around an end of the shaft to block leakage of coolant out of the pump housing through an interface between the housing and the shaft. The seal, however, may be positioned in a region of reduced convective cooling and thus subjected to high temperatures that may cause deterioration of the seal material. Continued exposure to heat may lead to coolant leakage and seizing of the pump.

One approach to address the issue of thermal degradation of the seal is shown by Stirling in U.S. Pat. No. 5,195,867. Therein, a seal around an impeller shaft of a pump is arranged in an annular seal chamber integrated into a housing wall of the pump chamber. Curved vanes are mounted in an entrance of the seal chamber and project into the seal chamber, causing fluid in the pump chamber to be diverted into the seal chamber. Coolant is thus forced to flow through the seal chamber and convectively cool the seal.

However, the inventors herein have recognized potential issues with such systems. As one example, arranging identical vanes equidistant around a circumference of the seal chamber maintains an equal pressure profile across the seal chamber that may not encourage sufficient circulation rates through the seal chamber to extract heat efficiently over prolonged periods of time. For example, the flow within the seal chamber may be lower than coolant circulation through the pump chamber, with minimal exchange between the sluggish flow of coolant in the seal chamber and rapid flow of coolant through the pump chamber. While the vanes may maintain a lower coolant temperature at the seal during initial stages of engine operation, the coolant temperature may gradually warm, thus exposing the seal to elevated temperatures. Additionally, in some examples, a pocket of air may form within the seal chamber, further isolating the seal from contact with coolant.

In one example, the issues described above may be addressed by a cooling system pump, including a housing enclosing an impeller rotatable about a drive shaft, a seal sealing an interface between the drive shaft and the housing, and a first flow-adjusting tab and a second flow-adjusting tab positioned along an outer circumference of an inner chamber of the housing, the first tab spaced away from the second tab by a gap and having a different geometry than the second tab. In this way, a pressure differential is created across the seal chamber, driving a cross-flow of coolant therethrough.

As one example, by positioning a set of anti-vortex tabs along the circumference of the inner chamber of the pump, flow in the region of the set of anti-vortex tabs is restricted, resulting in an increase in pressure relative to an oppositely positioned region of the inner chamber. The pressure gradient causes coolant to flow across the inner chamber, across the centrally-disposed seal and thereby convectively cooling the seal and mitigating formation of a thermally insulating vortex. Furthermore, the pressure jet formed at the gap between the first tab and the second tab of the set of anti-vortex tabs may also encourage diversion of coolant flow from the circumference of the inner chamber towards the seal. Heat is thereby efficiently extracted from the seal, prolonging a lifetime of the seal and reducing a likelihood of coolant loss by leakage.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-8 are shown approximately to scale

DETAILED DESCRIPTION

Figure 1:
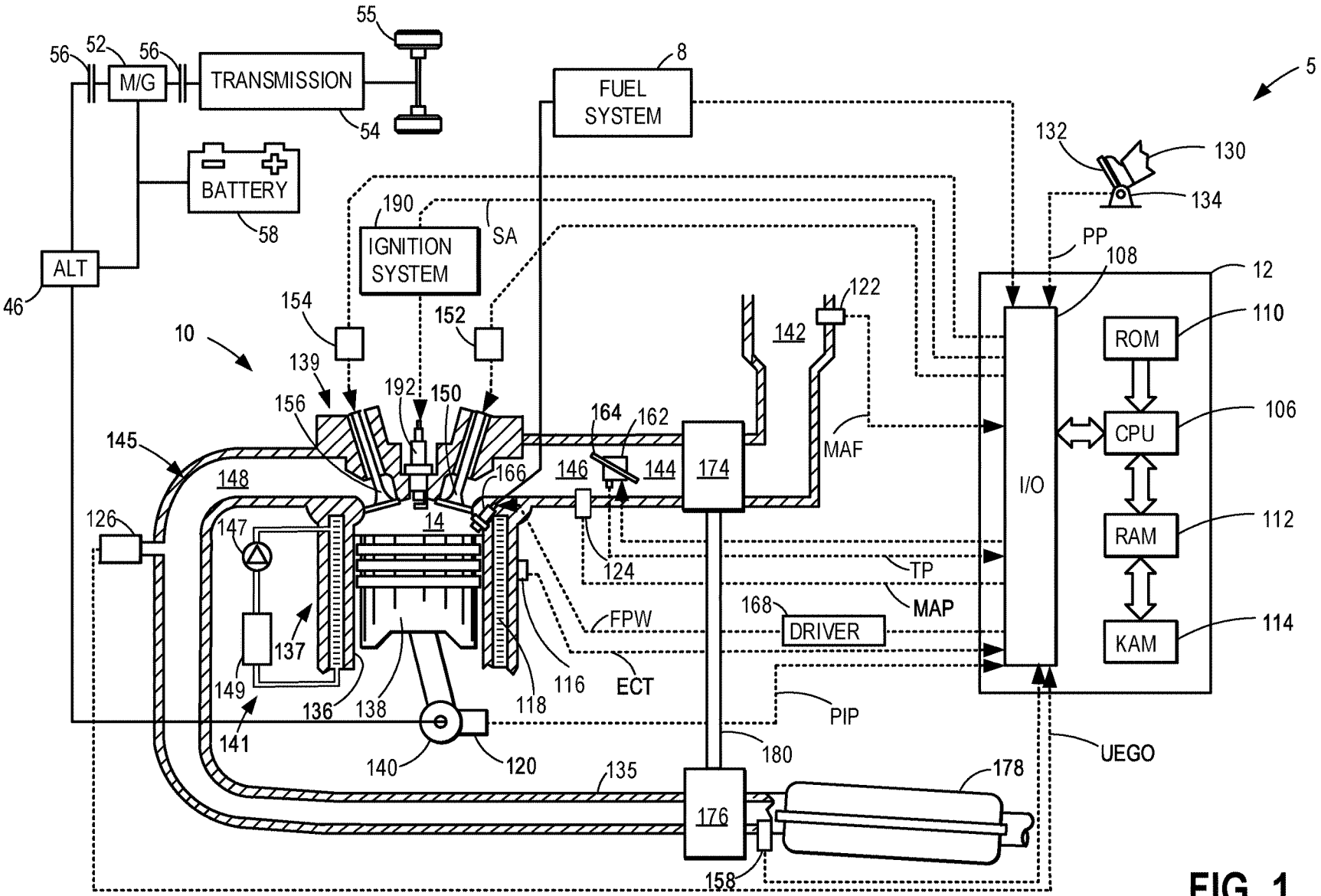
FIG. 1 shows a schematic diagram of an engine that may be cooled by a cooling system that includes a centrifugal coolant pump.
Figure 2:
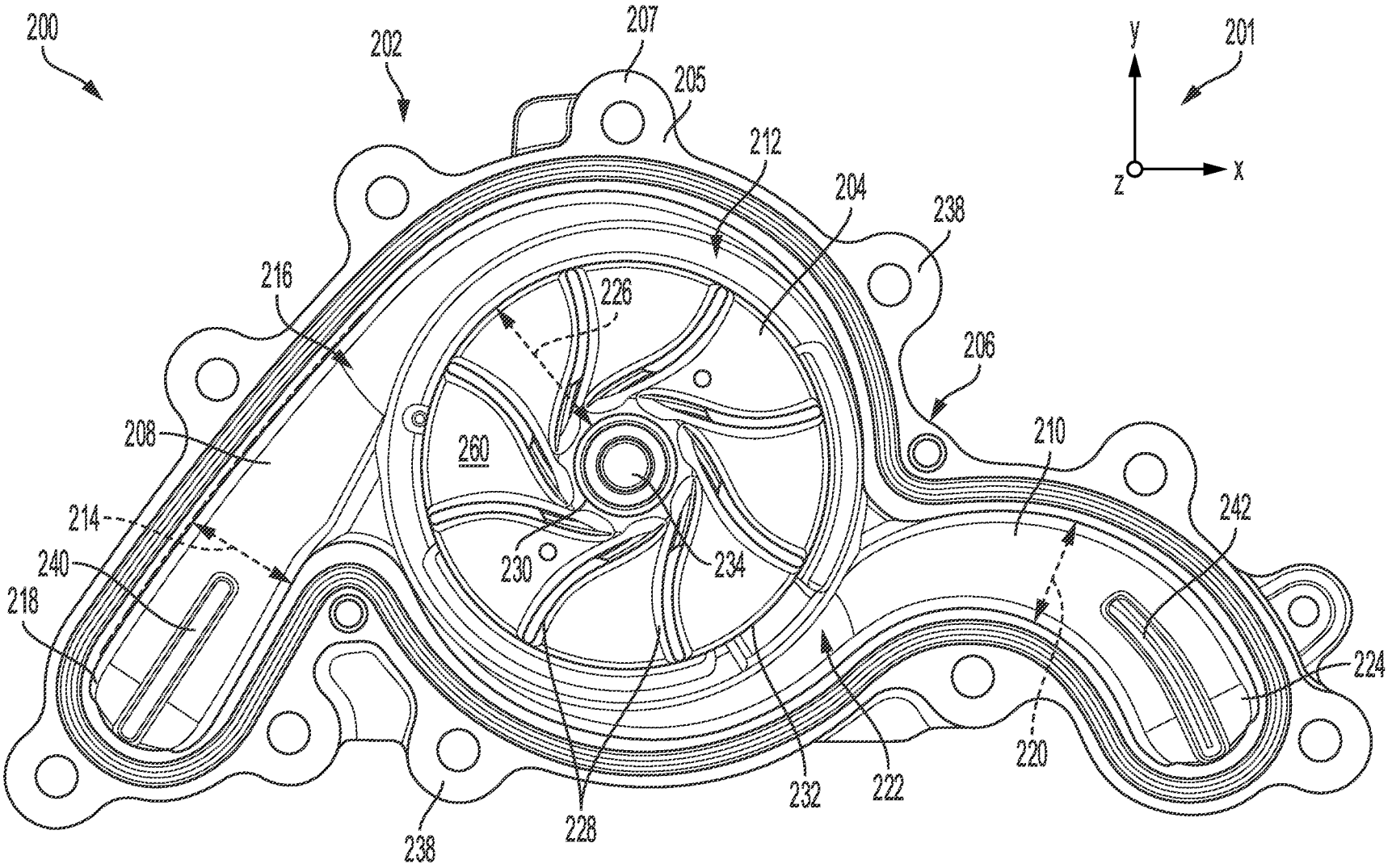
FIG. 2 shows a first front view of an inner chamber of a coolant pump, housing an impeller and adapted with anti-vortex elements.
Figure 3A:
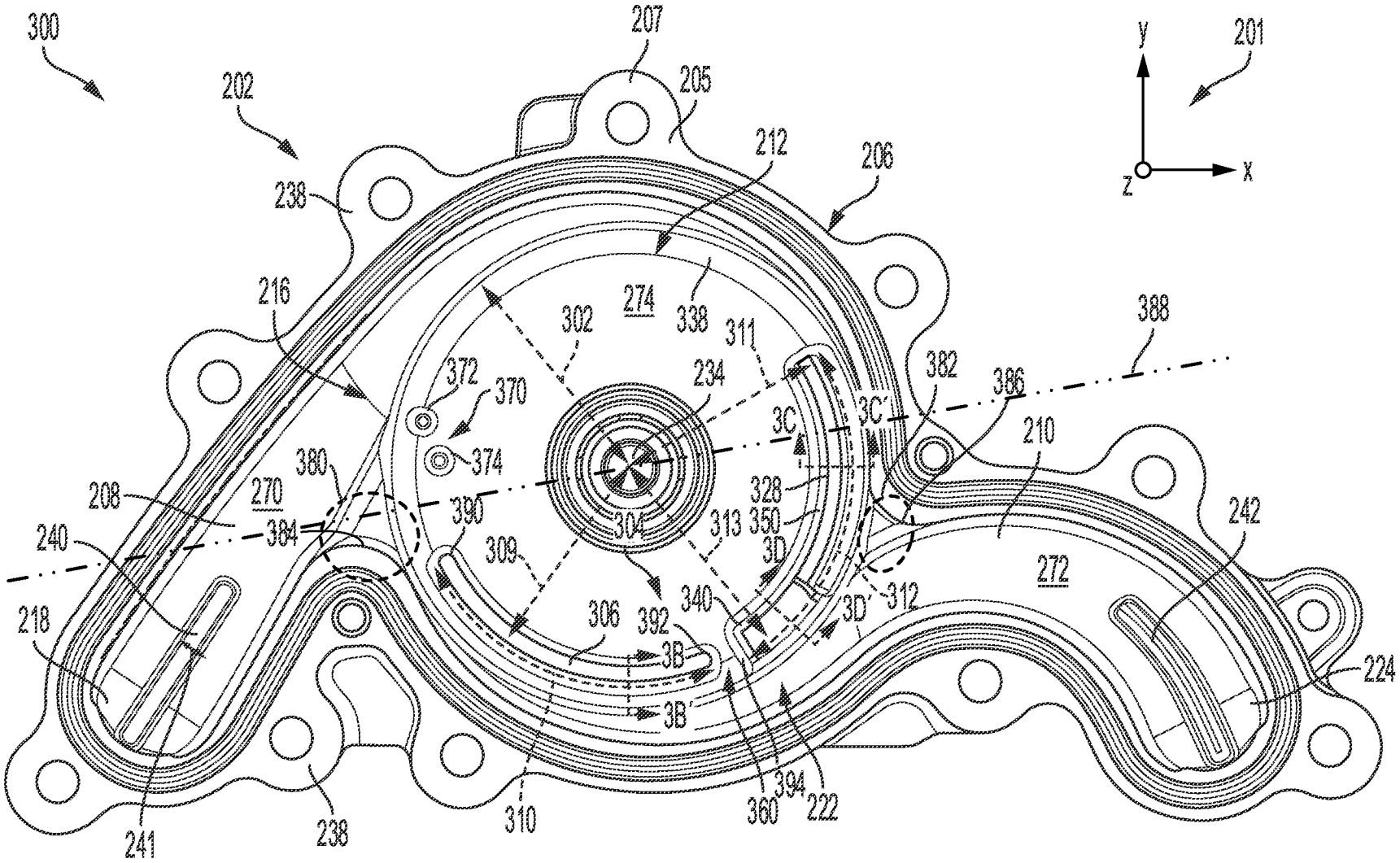
FIG. 3A shows a second front view of the inner chamber of the coolant pump including a set of anti-vortex elements, with the impeller omitted.
Figure 3B:
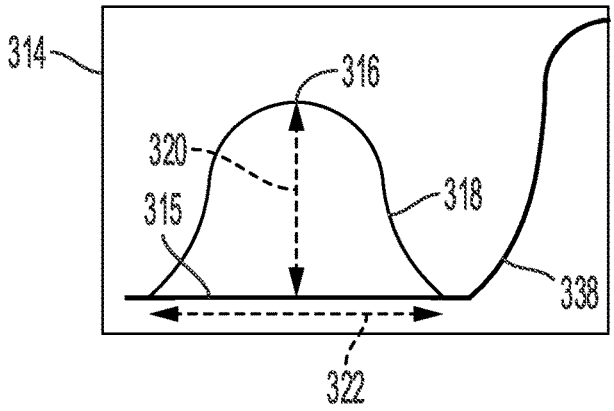
FIG. 3B shows a first cross-section of the set of anti-vortex elements of FIG. 3A.
Figure 3C:
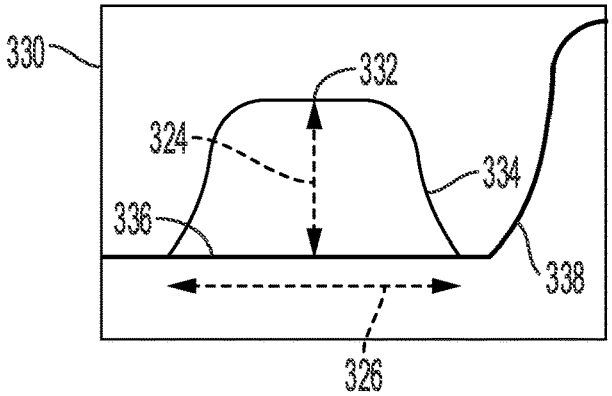
FIG. 3C shows a second cross-section of the set of anti-vortex elements of FIG. 3A.
Figure 3D:
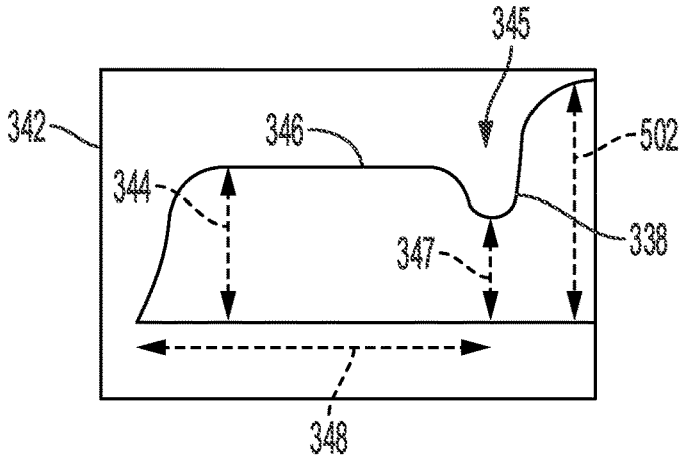
FIG. 3D shows a third cross-section of the set of anti-vortex elements of FIG. 3A.
Figure 4:
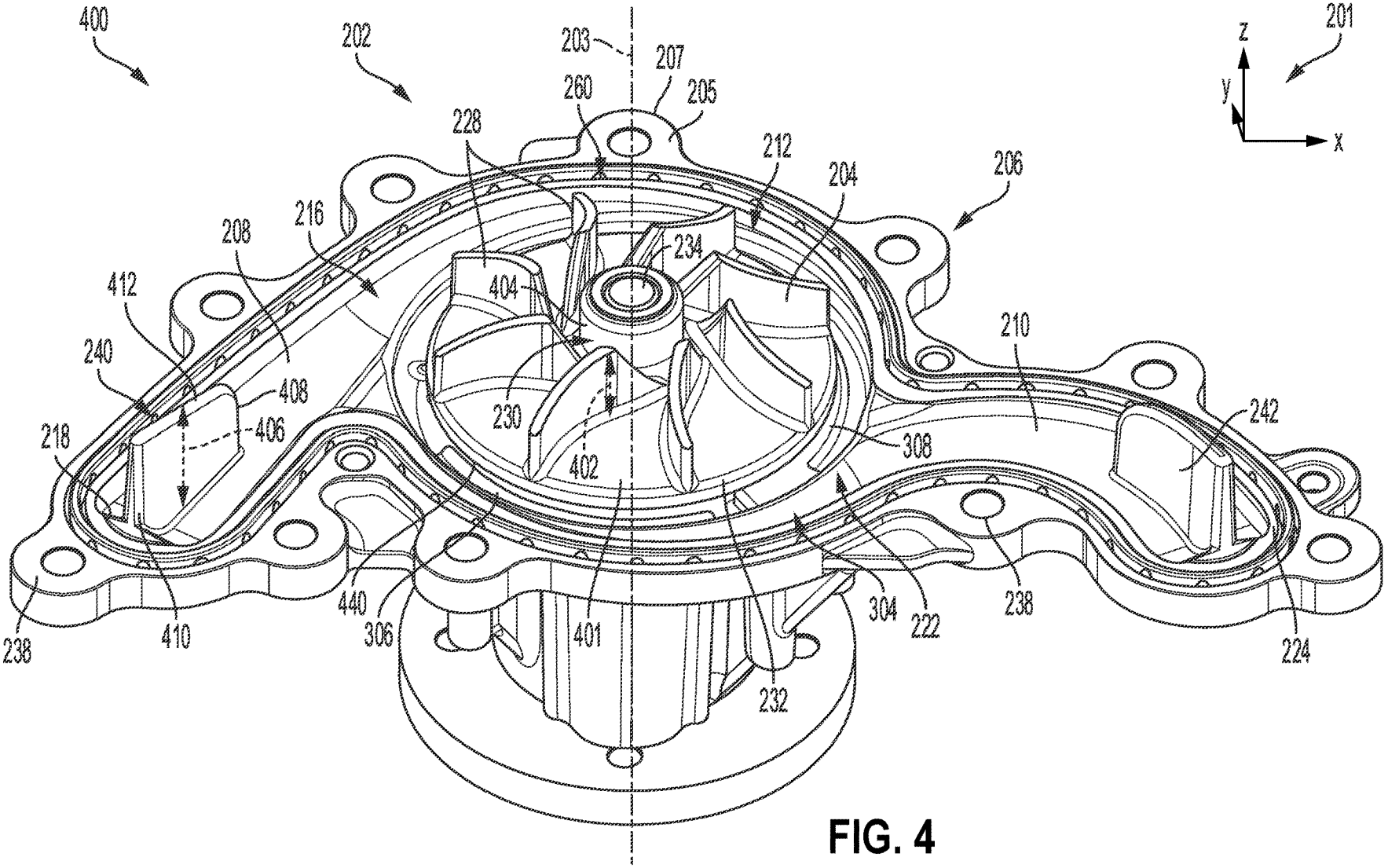
FIG. 4 shows a first perspective view of the inner chamber of the coolant pump, including the impeller.
Figure 5:
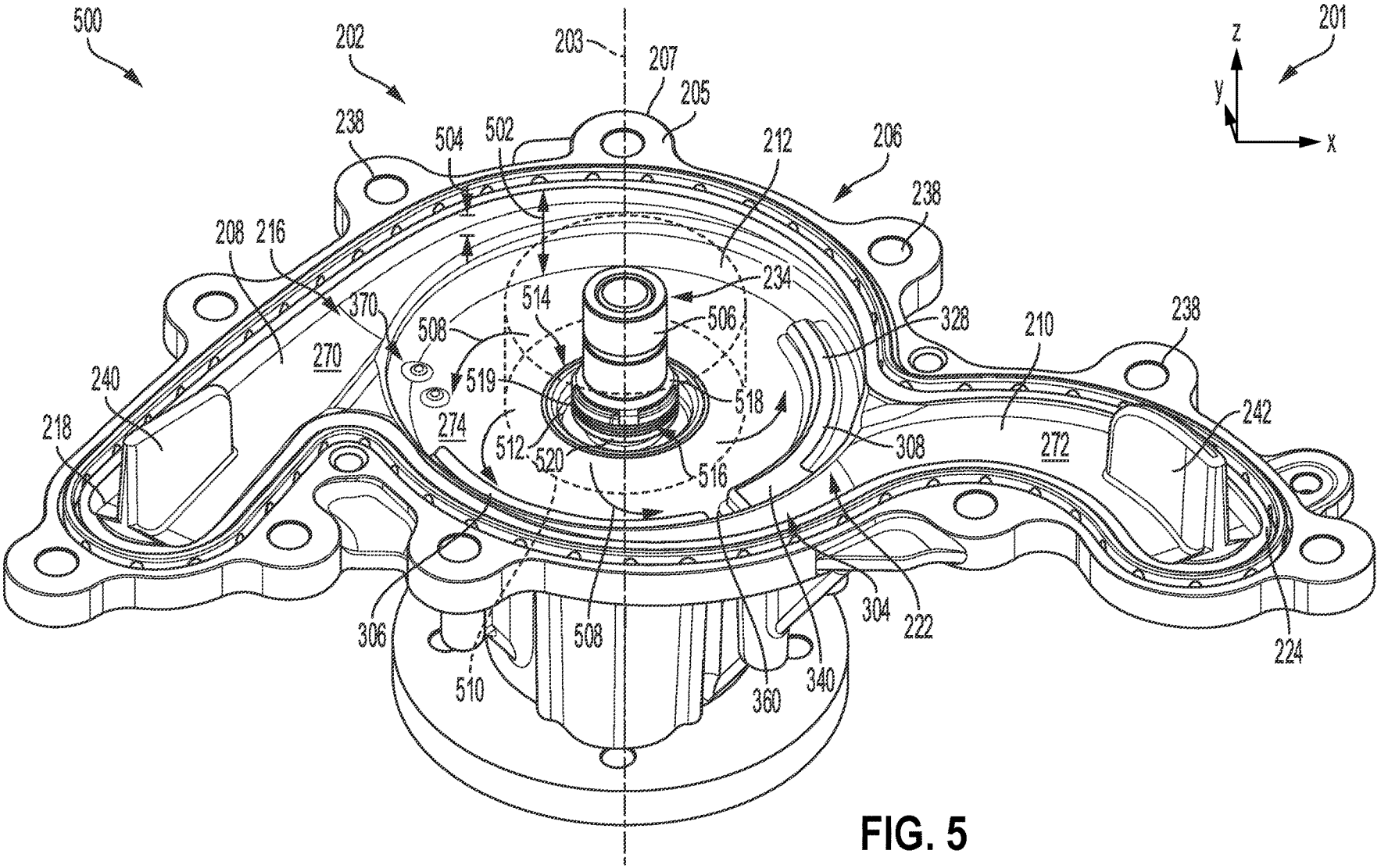
FIG. 5 shows a second perspective view of the inner chamber of the coolant pump with the impeller omitted.
Figure 6:
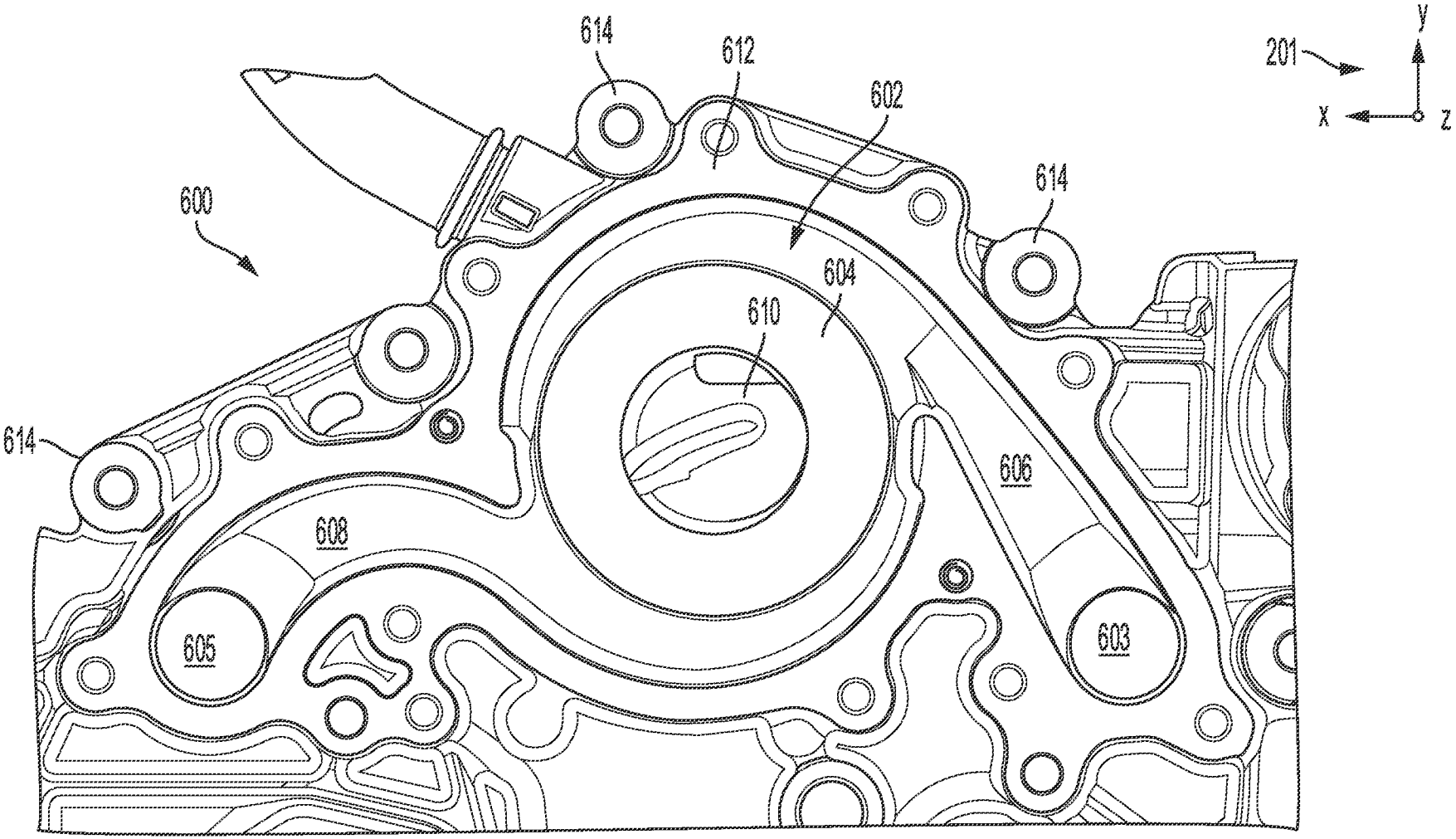
FIG. 6 shows a region of an engine block to which the coolant pump may be directly coupled.
Figure 7:
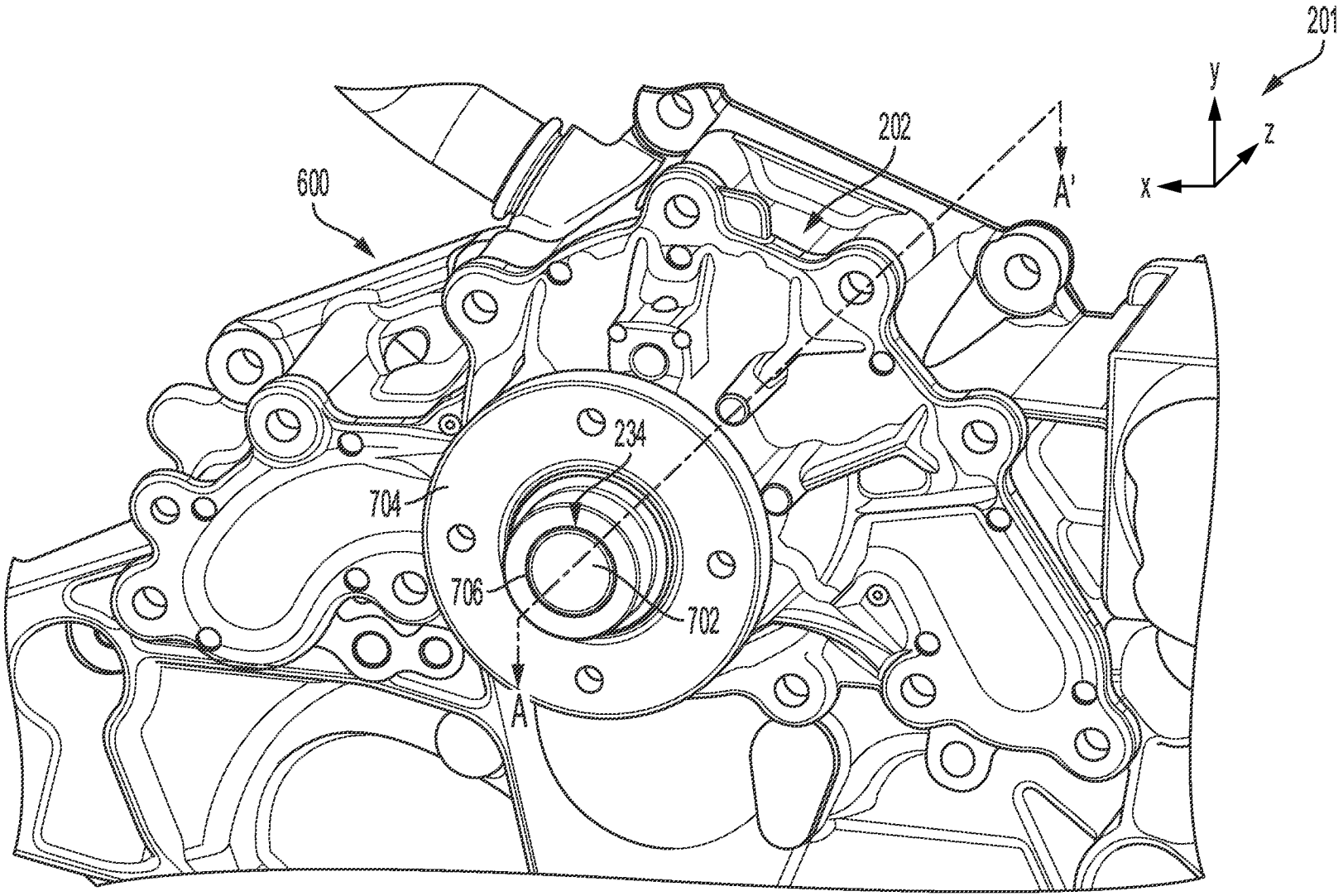
FIG. 7 shows the coolant pump coupled to the engine block.
Figure 8:
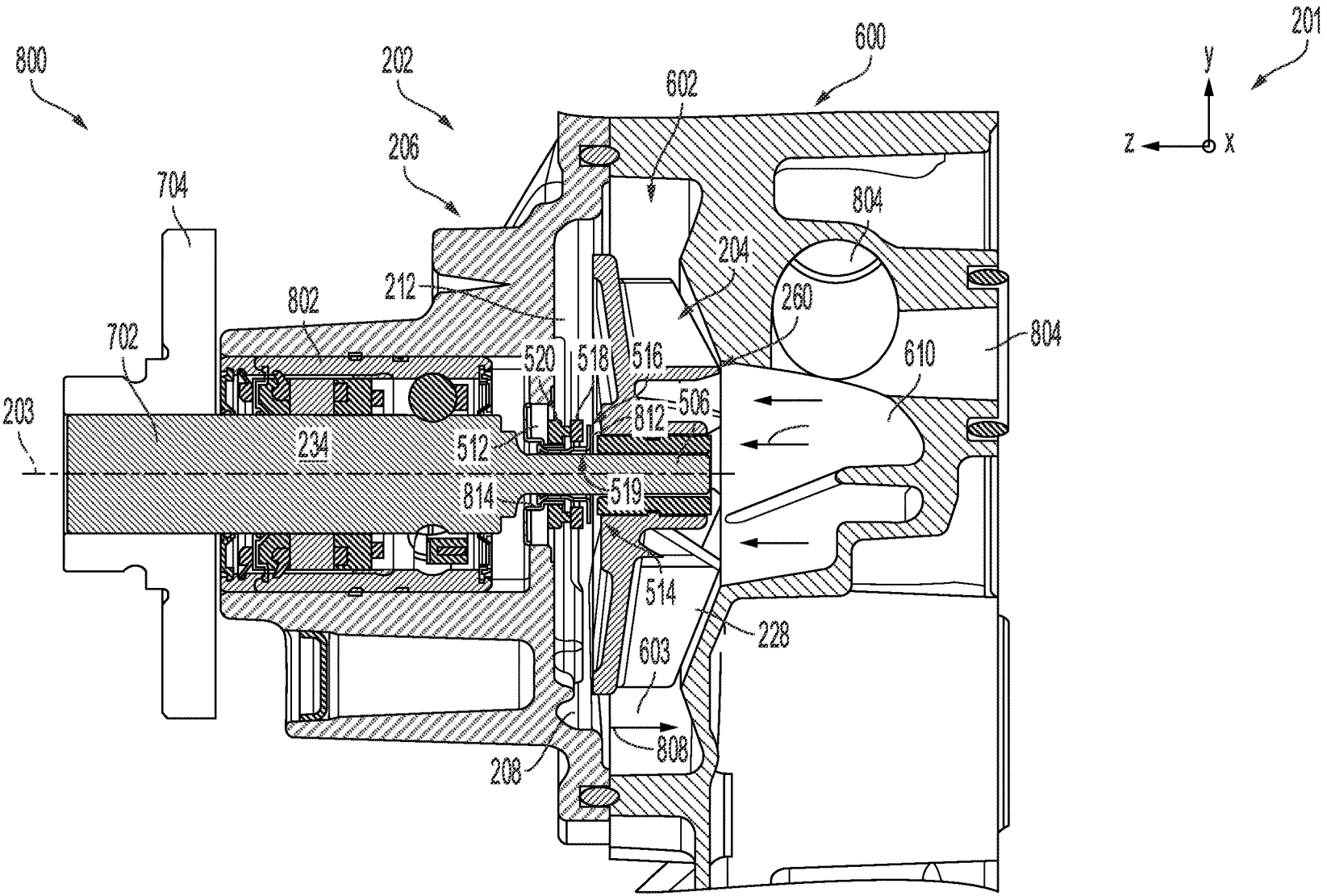
FIG. 8 shows a cross-section of the coolant pump when the coolant pump is coupled to the engine block.
Figure 9:
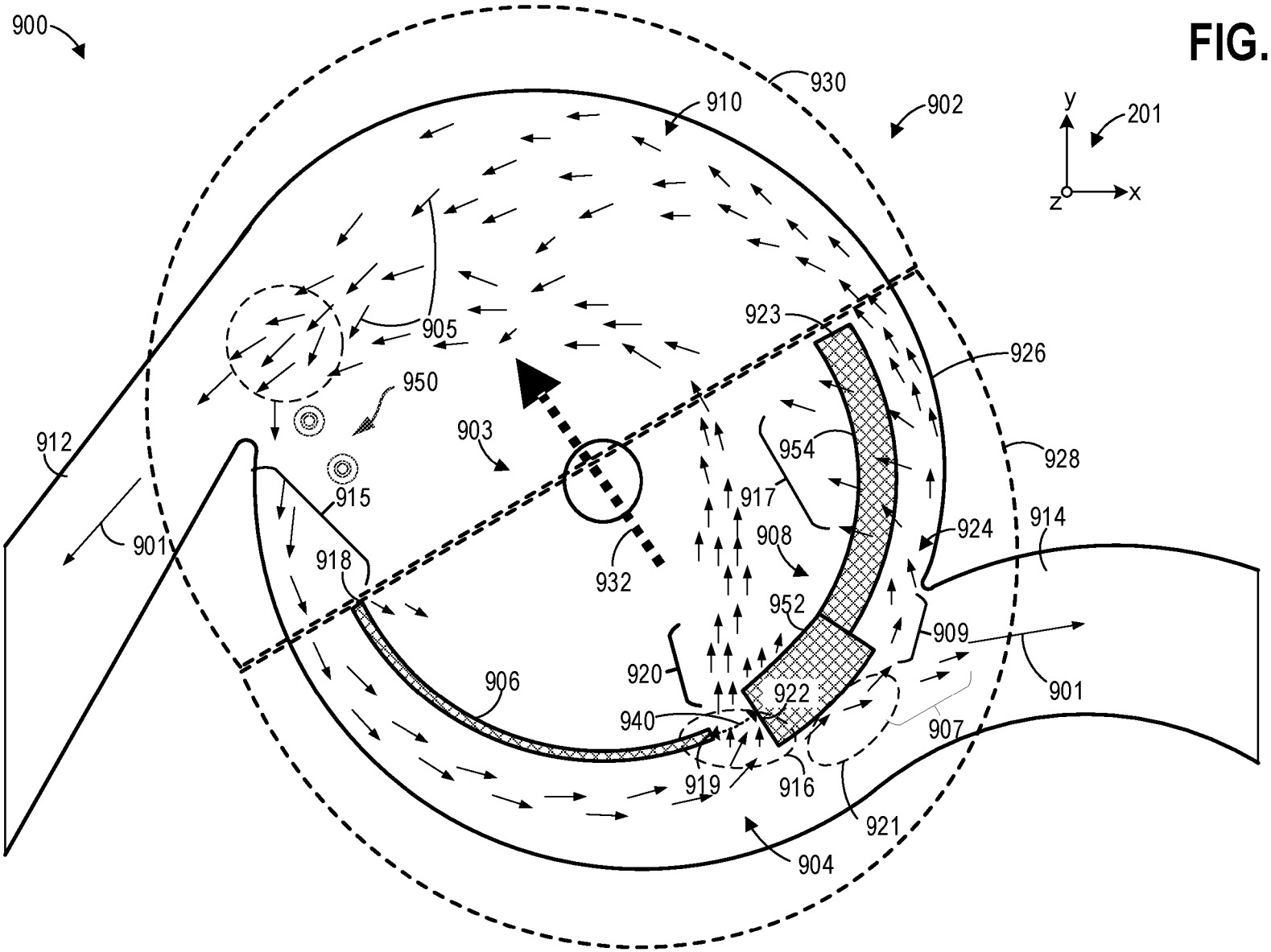
FIG. 9 shows a schematic diagram of a flow field within an inner chamber of a coolant pump configured with anti-vortex elements.
Figure 10:
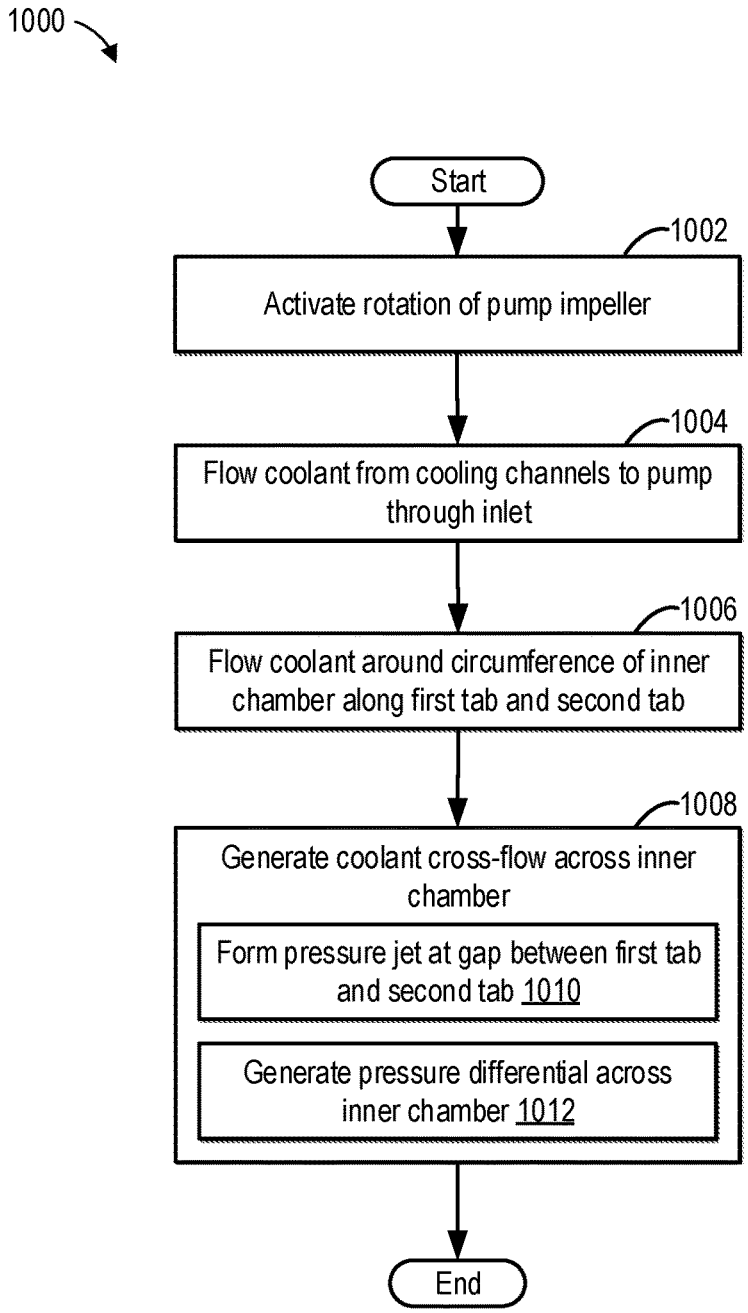
FIG. 10 shows an example of a routine for generating cross-flow across an inner chamber of a coolant pump to convectively cool a seal sealing an interface between the pump housing and an impeller shaft.

The following description relates to systems and methods for a dual-volute coolant pump adapted with inner structures to promote convective cooling of a coolant pump seal. The coolant pump may be used in a vehicle engine to circulate coolant through an engine block. An example of an engine system relying on convective cooling by a coolant is shown in FIG. 1. The coolant pump may be enclosed within an outer casing that defines outlet passages for fluidly coupling the coolant pump to coolant channels in the engine block. The coolant pump may include an inner chamber where a seal surrounding an impeller shaft may be disposed. The inner chamber is shown in FIG. 2 with an impeller coupled to the impeller shaft in a central region of the inner chamber and shown in FIG. 3A without the impeller to depict a set of anti-vortex elements integrated into the inner chamber. The anti-vortex elements may be a series of tabs that affect coolant flow within the inner chamber, inhibiting formation of a fluid vortex that may lead to reduced circulation of coolant around the seal. Cross-sections along different regions of the set of anti-vortex elements are shown in FIGS. 3B-3D. The inner chamber is also shown in FIGS. 4 and 5, with and without the impeller in place, respectively, from a perspective view. The coolant pump may be directly coupled to the engine block at a region of the engine block configured with a groove and bosses, where the region of the engine block is depicted in FIG. 6, to match a geometry of the casing of the coolant pump, thereby allowing the coolant pump to couple to the engine block and efficiently drive coolant flow through the engine block. The coolant pump is illustrated in FIG. 7, attached to the engine block, with a fly wheel connected to the impeller of the coolant pump and configured to transmit rotational motion from another component to the impeller. A cross-section of the coolant pump and the region of the engine block to which the pump is fitted is shown in FIG. 8. An effect of the anti-vortex tabs arranged in the inner chamber of the coolant pump on fluid velocity within the inner chamber is depicted in a schematic diagram in FIG. 9, illustrating a cross-flow of coolant across the inner chamber that disrupts vortex formation. A routine depicting how the seal, configured to inhibit loss of coolant through the interface between the impeller shaft and the pump housing, may be convectively cooled via implementation of the set of anti-vortex elements in the pump is shown in FIG. 10.

FIGS. 2-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Efficient engine cooling by a fluid that extracts heat from regions of the engine subject to elevated temperatures may prolong engine life and reduce maintenance and replacement of engine components. A flow of coolant through channels in the engine may be driven by a coolant pump. In some examples, the coolant pump may be a centrifugal pump that relies on an impeller that rotates within an inner chamber of the coolant pump. As the impeller rotates, a centrifugal force created by the spinning impeller forces coolant inside the inner chamber against an outer perimeter of the inner chamber, compelling the coolant to exit the inner chamber through outlet channels. The rotational velocity of coolant as imparted by the impeller may be converted to pressure energy.

The inner chamber of the coolant pump, enclosing the impeller, may be a circular chamber in which a uniform pressure is generated around a circumference of the chamber as the impeller is rotating the coolant. The uniform pressure may encourage formation of a fluid vortex in a central region of the inner chamber, around the impeller shaft, that reduces entrainment of new coolant from an inlet passage into the inner region of the inner chamber, proximate to the shaft.

A base of the impeller shaft may be configured with a seal that blocks leakage of coolant out through an interface between an outer housing, or casing, of the coolant pump and the impeller. The seal may be in contact with both the outer housing of the coolant pump and the impeller shaft and may thus be exposed to elevated temperature transmitted through both components. Reduced circulation of fresh coolant into the inner chamber of the coolant pump may decrease convective cooling of the seal when a vortex is formed by the rotating coolant, thereby allowing a temperature of the seal to rise. A material of the seal may not withstand prolonged and repeated heating and may be prone to thermal degradation, leading to coolant leakage out of the coolant pump outer housing and loss of convective cooling of the engine block.

Degradation of the coolant pump seal may be circumvented, at least in part, by configuring the inner chamber with a set of tabs protruding from a surface of the inner chamber. The set of tabs may be positioned directly in a path of coolant flow around the outer perimeter, or radial circumference, of the inner chamber, disrupting the circular flow path. The disruption generates a non-uniform velocity distribution around the inner chamber, therefore forming a pressure differential that drives cross-flow of coolant. Circulation of new coolant around the impeller shaft, in contact with the seal, is thereby increased, enhancing convective cooling of the seal. Further details of the coolant pump and set of anti-vortex tabs disposed within are provided below in the following descriptions of FIGS. 1-10.

Turning now to the figures, FIG. 1 depicts an example of a cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 via a transmission 54, as further described below. Further, a starter motor (not shown) may be coupled to crankshaft 140 via a flywheel to enable a starting operation of engine 10.

A cooling jacket 118 may be disposed in chamber walls 136 within a cylinder block 137 or engine block 137 of engine 10. In some examples, another cooling jacket may be arranged in a cylinder head 139 of engine 10 or the cylinder block 137 may be configured with more than one cooling jacket, each cooling jacket similarly coupled to a cooling system 141 as the cooling jacket 118. The cooling system 141 may be a parallel flow, split flow, parallel-split flow or other cooling arrangement and be adapted with valves and/or thermostats (not shown) to control coolant flow or pressure or direct coolant within the cooling system 141.

The cooling system 141 includes, in addition to the cooling jacket 118, a coolant passage 143 defining a path of coolant flow, coolant pump 147, and a heat exchanger 149. The coolant may be water, glycol, or another liquid medium and flows from an area of high pressure towards an area of lower pressure. The heat exchanger 149 may be a fluid cooling device such as a radiator where heat is transferred from the coolant to the environment.

While the cooling system 141 is shown with one coolant pump 147, other examples may include more than one coolant pump. The coolant pump 147 may be driven by a mechanical coupling to the crankshaft 140 or to another rotating engine component. Alternatively, the coolant pump 147 may be powered by an electric motor. Coolant is pressurized by the coolant pump 147, driving a pressure gradient-based flow of coolant through the cooling system 141 that circulates from the coolant pump 147, through the cylinder block 137 and/or the cylinder head 139, and out of engine 10 to the heat exchanger 149, thus returning cooled coolant to the coolant pump 147.

When configured as a centrifugal pump, coolant pump 147 may include an impeller within one or more volutes of the coolant pump 147. As the impeller rotates, coolant is forced to flow radially outwards within the one or more volutes, driving flow through the volute(s). A seal may be arranged around an impeller shaft in an inner chamber of the coolant pump 147, sealing a region between the shaft and a housing of the coolant pump 147 that forms the volute(s). As a result of the radial, outwards movement of the coolant, the coolant in the seal chamber may experience little exchange with incoming, cooler coolant and a temperature of the coolant may rise during engine operation. The seal chamber may be adapted with elements that generate a pressure gradient within the seal chamber that induces coolant cross-flow, increasing convective cooling of the seal and reducing thermal degradation of the seal material. Further details of the coolant pump and flow-modifying elements are discussed further below with reference to FIGS. 2-9.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based upon system usage requirements, including auxiliary system demands.

Cylinder 14 of engine 10 can receive intake air via a series of intake passages 142 and 144 and an intake manifold 146. Intake manifold 146 can communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

An exhaust system 145 is coupled to cylinder 14 via a poppet valve 156. The exhaust system includes an exhaust manifold 148, an emission control device 178. Exhaust manifold 148 can receive exhaust gases from other cylinders of engine 10 in addition to cylinder 14. An exhaust gas sensor 126 is shown coupled to exhaust manifold 148 upstream of an emission control device 178. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO. Emission control device 178 may be a three-way catalyst, a NOx trap, various other emission control devices, or combinations thereof. In the example of FIG. 1, emission control device 178 is a three-way catalyst.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

Each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, spark may be retarded from MBT, such as to expedite catalyst warm-up during engine start or to reduce an occurrence of engine knock.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and further configured to inject this fuel mixture directly into cylinder. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, or the first and second fuels may differ in other fuel qualities, such as a difference in temperature, viscosity, octane number, etc. Moreover, fuel characteristics of one or both fuel tanks may vary frequently, for example, due to day-to-day variations in tank refilling.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to the cooling jacket 118; an exhaust gas temperature from a temperature sensor 158 coupled to exhaust passage 135; a profile ignition pickup signal (PIP) from a Hall effect sensor 120 (or other type) coupled to crankshaft 140; throttle position (TP) from a throttle position sensor; signal UEGO from exhaust gas sensor 126, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of emission control device 178 based on the signal received from temperature sensor 158.

Controller 12 receives signals from the various sensors of FIG. 1 and employs the various actuators of FIG. 1 to adjust engine operation based on the received signals and instructions stored on a memory of the controller. For example, the controller may estimate the intake manifold temperature based on a signal from the temperature sensor 116 coupled to the cooling jacket 118 and used the inferred intake manifold temperature to adjust a flow of coolant through the engine block 147.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

An engine, as described above, may rely on convective cooling by a coolant to maintain an engine temperature within a range that reduces thermal degradation of engine components. A drive shaft seal of a coolant pump may be exposed to elevated temperatures from the engine components and similarly rely on convective cooling from coolant circulated therein. To circumvent formation of a vortex within the coolant pump, the vortex inhibiting circulation of new, cooler coolant into a central region of an inner chamber of the coolant pump, the inner chamber may include a set of structures directly in the path of coolant flow that interferes with vortex generation. An example of a coolant pump adapted with such structures is shown in FIGS. 2-6.

In FIG. 2 a first front view 200 of a dual-volute coolant pump 202 (hereafter pump 202) is depicted where an outer housing, or casing 206, that partially enshrouds inner elements of the pump 202, is detached from an engine or cylinder block, such as the cylinder block 137 of FIG. 1. In other words, a portion, such as a half, of a volume of the pump 202 is shown in FIG. 2 (as well as in FIGS. 3-5). In one example, the pump 202 may be the coolant pump 147 of FIG. 1. A similar second front view 300 of the pump 202 is shown in FIG. 3 but with an impeller 204 of the pump 202 removed. Similarly, the pump 202 is shown in FIG. 4 from a first perspective view 400 with the impeller 204 present and from a second perspective view 500 in FIG. 5 with the impeller 204 omitted. As such, FIGS. 2-5 are similarly numbered and discussed collectively. A set of reference axes 201 are included for comparison between views, indicating a y-axis, an x-axis, and a z-axis. In addition, pump 202 has a central axis 203, as shown in FIGS. 4 and 5.

The casing 206 surrounds at least one side of the dual-volute coolant pump 202, opposite of a side of the pump 202 coupled to the engine block. Adapted with a dual volute, the pump 202 has a first volute, or outlet 208 and a second volute, or outlet 210, extending radially outwards, e.g., away from the central axis 203, from an inner chamber 212 of the pump 202. The first outlet 208 and the second outlet 210 extend along a common plane, e.g., the x-y plane, perpendicular to the central axis 203. Each of the first outlet 208 and the second outlet 210 may be passageways defined partially by the casing 206 and partially by the engine block that fluidly couple the inner chamber 212 to cooling channels in the engine block, shown further below with reference to FIGS. 6-8.

The first outlet 208 may extend linearly from an upper (with respect to the y-axis) left side of the inner chamber 212, along the x-y plane and at an angle to the y-axis, in a downwards direction with respect to the y-axis. For example, the first outlet 208 may extend, or swirl in a counter-clockwise direction from the inner chamber 212. A width 214, as shown in FIG. 2, of the first outlet 208 may widen from a first intersecting region 216 of the first outlet 208 and the inner chamber 212 to an end 218 of the first outlet 208. In one example, the width 214 of the first outlet 208 proximate to the end 218 may be similar to a radius 302, shown in FIG. 3, of the inner chamber 212. The first intersecting region 216 may be a zone of high flow where coolant flow velocity may be higher than in adjacent regions, such as in the inner chamber 212 or at a the end 218 of the first outlet 208. In other examples, the width 214 may be smaller or larger than the radius 302 of the inner chamber 212 and taper by a greater or lesser amount than shown in FIGS. 2-5.

The second outlet 210 may have a similar width 220, indicated in FIG. 2, to the first outlet 208. The width 220 of the second outlet 210 may also taper, being narrower at a second intersecting region 222 of the inner chamber 212 and the second outlet 210 than an end 224 of the second outlet 210. The second outlet 210 may be positioned opposite from the first outlet 208, extending, or swirling from a lower (with respect to the y-axis) right side of the inner chamber 212 in the counter-clockwise direction. Unlike the first outlet 208, the second outlet 210 may be curved, initially curving upwards and away from the inner chamber 212 in the x-y plane, and then curving downwards at the end 224 of the second outlet 210.

The first outlet 208 may include a first fin 240 arranged in the first outlet 208 proximate to the end 218 and the second outlet 210 may include a second fin 242 proximate to the end 224 of the second outlet 210. The first fin 240 and the second fin 242 may be narrow, wall-like structures extending upwards, relative to the z-axis from surfaces of the first outlet 208 and the second outlet 210 defined by the casing 206. The first fin 240 may have straight sides and the second fin 242 may have curved sides, as shown in FIGS. 2 and 3, to accommodate geometries of the first outlet 208 and the second outlet 210 at the respective ends 218, 224. However, in all other aspects, such as dimensions and profile, the first fin 240 and the second fin 242 may be similar and while the following description is directed to the first fin 240, the second fin 242 may be similarly structured.

The first fin 240 may have a relatively uniform width 241, as shown in FIG. 2, but a height 406 of the first fin 240, shown in FIG. 4, may increase from a first end 408 to a second end 410 of the first fin 240. An intersection of the first end 408 with a top edge 412 of the first fin 240 may be curved while an intersection of the second end 410 with the top edge 412 may be sharp, e.g., forming a perpendicular corner. The first fin 240 is arranged in the first outlet 208 so that the width 241 of the first fin 240 is perpendicular to coolant flow through the first outlet 208 and the top edge 412 is parallel with coolant flow. As coolant comes into contact with surfaces of the first fin 240, friction generated between the coolant and the surfaces slows the flow velocity of the coolant exiting the first outlet 208. The deceleration of the flow allows an increase in pressure within the first outlet 208 of the pump 202 relative to the inner chamber 212. The higher pressure in the first outlet 208 (and the second outlet 210) creates a suction effect and aids in drawing coolant from cooling channels upstream of the pump 202 into the inner chamber 212 of the pump 202 through an inlet of the pump 202.

A portion of an engine block 600 is shown in FIG. 6 that provides half of the outer housing of the pump 202. The engine block 600 is configured to couple to the casing 206 of the pump 202. The engine block 600 includes a groove 602 that matches a shape of the pump 202 and is a mirror-image of the geometry of the inside of the casing 206, as shown in FIGS. 2 and 3. The groove 602 forms a ceiling 604 for the inner chamber 212 of FIGS. 2-5, as well as an upper surface 606 for the first outlet 208 and an upper surface 608 for the second outlet 210 of the pump 202. The upper surface 606 for the first outlet 208 includes a first outlet port 603 and the second upper surface 608 for the second outlet 210 includes a second outlet port 605. The ceiling 604 has a circular central opening 610 that couples the inner chamber 212 of the pump 202 to a coolant channel of the engine block 600. In other words, the central opening 610 is an inlet 610 of the pump 202, flowing coolant from a water jacket or coolant reservoir of the engine block 600 to the inner chamber 212 of the pump 202. The inlet 610 flows coolant into the inner chamber 212 along the central axis and perpendicular to coolant flow leaving the pump 202 through the first and second outlets, 208 and 210.

The groove 602 is bordered by a gasket 612 configured to seal against a face 205, aligned with the y-x plane, of a frame 207 of the casing 206, as shown in FIG. 2. When the frame 207 of the casing 206 is aligned and pressed against the gasket 612, the gasket 612 may be in face-sharing contact with the frame 207, providing a seal around the pump 202 that inhibits coolant leakage through an interface between the engine block 600 and the casing 206, constraining coolant flow to the inlet 610 and the first and second outlets 208, 210. The engine block 600 may include a plurality of bosses 614 around the gasket 612 that align with a plurality of bosses 238, as shown in FIGS. 2-5, in the casing 206 to allow the casing 206 to be secured to the engine block 600 via bolts or other fastening devices.

It will be appreciated that the example of the dual-volute coolant pump 202 is a non-limiting example and variations in a geometry of the first and second outlets 208, 210 have been contemplated. In other examples, the relative positioning of the outlets as well as the relative shapes and dimensions of the outlets may vary without departing from the scope of the present disclosure.

As shown in FIG. 5, the inner chamber 212 may be a circular central region of the pump 202 that has a greater depth 502 than a depth 504 of the first outlet 208 or the second outlet 210, the depths defined along the y-axis and measured from the face 205 of the frame 207 of the casing 206 to each of a bottom (or inner) surface of the first outlet 270, a bottom surface of the second outlet 272, and a bottom surface 274 of the inner chamber 212. As such, the bottom surfaces 270, 272 of the first outlet 208 and the second outlet 210 may be higher, along the z-axis, than the bottom surface 274 of the inner chamber 212. The inner chamber 212 may receive coolant from the inlet 610 of FIG. 6 on the side of the pump 202 formed in the engine block 600, flowing coolant to a first face 260 of the impeller 204 (as seen in FIG. 2), as positioned in the inner chamber 212. The impeller 204, as shown in FIGS. 2 and 4, has a geometry that matches a shape of the inner chamber 212 and may have a radius 226 smaller than the radius 302 of the inner chamber 212 to allow the impeller 204 to rotate freely when nested in the inner chamber 212.

The impeller 204 has a plurality of blades 228 that curve sinuously from an inner edge 230 of the impeller 204 to an outer edge 232, as shown in FIG. 2. The plurality of blades 228 may each have a maximum height 402, as shown in FIG. 4 and defined along the y-axis, that is similar to a height of the inner chamber 212, where the height of the inner chamber 212 is equal to a distance from the bottom surface 274, relative to the z-axis, of the inner chamber 212 to the ceiling 604 of the groove 602 of the engine block 600, as shown in FIG. 6, and includes the depth 502 of the inner chamber 212. The height 402 of each of the plurality of blades 228 may decrease towards the outer edge 232 of the impeller 204. As coolant enters the pump 202 via the inlet 610 (shown in FIG. 6) positioned above, relative to the z-axis, a central region of the impeller 204 at the first face 260 of the impeller 204, the coolant is forced to either directly interact with the plurality of blades 228, or be entrained into swirling coolant as induced by the rotation of the impeller 204.

Rotation of the impeller 204 is propelled by a shaft 234 that extends through a central opening of the impeller 204 and through a central region of the inner chamber 212. The inner edge 230 of the impeller 204 may include a sleeve 404, as shown in FIG. 4, extending along the z-axis and surrounding a portion of the shaft 234. As depicted in FIG. 5, the shaft 234 is a cylindrical component that extends into the inner chamber 212 along an inner portion 506 of the shaft 234, and out of the inner chamber along an outer portion of the shaft (not shown in FIGS. 2-5), the outer portion enclosed within a drive mechanism, as shown and described below with reference to FIGS. 7 and 8. The inner portion 506 of the shaft 234 may be fixedly coupled to the impeller 204 so that rotation of the shaft 234 results in similar rotation of the impeller 204.

The shaft 234 has an outer portion 702, as illustrated in FIG. 7, that extends along the z-axis outside of the casing 206, e.g., external to the casing 206, and away from the inner chamber 212. The casing 206 is shown coupled to the engine block 600 in FIG. 7 so that the pump 202 is a complete, sealed structure. A flywheel 704 is coupled to the outer portion 702 of the shaft 234, with the outer portion 702 inserted through a central aperture 706 of the flywheel 704. The flywheel 704 may be fixedly coupled to the outer portion 702 of the shaft 234 and may assist in maintaining a position of the shaft 234.

For example, in a cross-section 800 shown in FIG. 8, taken along line A-A' in FIG. 7, the cross-section 800 shows the shaft 234 extending between the impeller 204 and the flywheel 704 along the z-axis. The shaft 234 may be secured to the impeller 204 and/or the flywheel 704 by a permanent coupling method, such as welding, or by a mechanism such as a locking pin or some other coupling device that allows the shaft 234 to be fixedly coupled to the impeller 204 and/or the flywheel 704 and detached when disassembly of the pump 202 is desired. The coupling of the shaft 234 to the impeller 204 and to the flywheel 704 locks a position of the shaft 234 through the pump 202 so that the shaft 234 does not slide along the z-axis. A portion of the shaft 234, between the impeller 204 and the flywheel 704, may extend through a shaft chamber 802 of the casing 206. The shaft chamber 802 may include various bearings and devices to allow smooth and frictionless rotation of the shaft 234 and also blocks movement of the shaft 234 along the x-y plane. The shaft 234 therefore spins in place, aligned with the central axis 203. Rotation of the shaft 234 may be driven, for example, by a rotating engine component, such as the crankshaft 140 of FIG. 1, or by an electric motor, with the driving device directly coupled to the flywheel 704.

The cross-section 800 illustrates a positioning of the inlet 610 of the pump 202 in the engine block 600 adjacent to the central region of the impeller 204 at the first face 260 of the impeller 204 and aligned along the central axis 203 with the shaft 234 of the impeller 204. Coolant may flow from various cooling channels 804 in the engine block 600 and merge with the inlet 610 of the pump 202, directing coolant flow towards the impeller 204, as indicated by arrows 806. In some examples, a heat exchanger, such as the heat exchanger 149 of FIG. 1, may be arranged in the path of coolant flow upstream of the inlet 610, thereby cooling the coolant before the coolant enters the pump 202. The coolant flows towards the inner chamber 212 and is diverted by the rotating plurality of blades 228 of the impeller 204. The rotation of the impeller 204 sweeps the coolant into circular flow, pushing the coolant outwards and away from the central axis 203.

The coolant is driven, by centrifugal force, to flow along the first outlet 208 and the second outlet 210 (not shown in FIG. 8) of the pump 202. In the cross-section 800, the first outlet 208 of the casing 206 is shown coupled to the first outlet port 603 of the engine block 600. The flow of coolant out of the first outlet 208 is indicated by arrow 808. Coolant may similarly flow out of the second outlet 210 into the second outlet port 605 of the engine block 600, as shown in FIG. 6.

Returning to FIG. 5, as the coolant is compelled to swirl and flow towards an outer perimeter of the inner chamber 212, as indicated by arrows 508, an inner zone 510 of the inner chamber 212, indicated by a dashed cylinder, centered about the central axis and the shaft 234 of the impeller 204, may be relatively depleted of coolant. A vortex of coolant may form within the inner zone 510 and, in some examples, a pocket of air may form within a recess 512 in the bottom surface 274 of the inner chamber 212 positioned around a base 514 of the inner portion 506 of the shaft 234.

The recess 512 may be circular and form a well around the base 514 of the inner portion 506 of the shaft 234. When the flow velocity of the coolant is uniform around the outer perimeter of the inner chamber 212, a pressure around the inner chamber may be also uniform, causing a vortex of coolant flowing at a constant and relatively low velocity around the inner zone 510. The low velocity vortex may have a low likelihood of drawing new, lower temperature coolant, entering through the inlet 610, into the inner zone 510 of the inner chamber 212. As a result, a temperature of the coolant swirling in the inner zone 510 may rise during prolonged engine operation as heat is transmitted through the casing 206 and the shaft 234. Furthermore, the swirling motion of coolant in the inner zone 510 may concentrate the coolant in a ring moving along the bottom surface 274 of the inner chamber 212, defined by the casing 206, above the recess 512. Thus, an insulating pocket of air may form in the recess 512, further decreasing contact between the coolant and the base 514 of the inner portion 506 of the shaft 234.

The rise in coolant temperature may occur due to thermal conduction from moving components of the pump 202, such as from the shaft chamber 802 where the bearings may become heated as the shaft 234 of the impeller 204 rotates or conduction of heat produced from a device or components driving rotation of the impeller 204 to the shaft 234. In addition, the casing 206 may be formed from heat conducting material, such as a metal, and thus also contributing to heating of the base 514 of the inner portion 506 of the shaft 234. As heat is conducted along the shaft 234, from the outer portion 702 to the inner portion 506, and through the casing 206, the base 514 of the inner portion 506 of the shaft 234 may also rise in temperature.

The casing 206 of the pump 202 may be coupled to the shaft 234 of the impeller 204 at the base 514. To mitigate potential leakage at the interface of the casing 206 and the shaft 234 at the base 514, a seal 516 may be positioned at the base 514. The seal 516 may circumferentially surround the base 514 of the inner portion 506 of the shaft 234 and seal the interface between the casing 206 and the base 514. The seal 516 may have several components, including a first ceramic disc 518, a second ceramic disc 520, and a retention mechanism 519, stacked along the central axis 203. When locked together, e.g., when the first ceramic disc 518 and the second ceramic disc 520 are in contact and pressed against one another by the retention mechanism 519, the components of the seal 516 may enable the seal 516 to be impermeable to coolant flow, e.g., the coolant may not flow through the seal 516. The arrangement of the seal 516 relative to the shaft 234 is also shown in the cross-section 800 of FIG. 8.

The seal 516 is shown in FIG. 8 surrounding the base 514 of the shaft 234, with the first ceramic disc 518 and the second ceramic disc 520 stacked along the central axis 203, the first ceramic disc 518 proximate to the impeller 204 and the second ceramic disc 520 proximate to the shaft chamber 802. An interface between the first ceramic disc 518 and the second ceramic disc 520, e.g., a region where the two discs are in contact, provides a sealing engagement between the two discs that blocks flow therethrough. Each of the first ceramic disc 518 and the second ceramic disc 520 are maintained in place by the retention mechanism 519.

The retention mechanism 519 may include a first spring 812 that is connected to the shaft 234 and in contact with the first ceramic disc 518. The first spring 812 may secure the first ceramic disc 518 to the shaft 234 so that the first spring 812 and the first ceramic disc 518 rotate with the shaft 234 while maintaining contact between the first ceramic disc 518 and the second ceramic disc 520. The retention mechanism may also include a second spring 814 that is connected to the casing 206 of the pump 202. The second spring 814 may interface with the second ceramic disc 520, anchoring the second ceramic disc 520 to the casing 206. The retention mechanism 519 may additionally include rubber elements that assist in maintaining the contact between the first ceramic disc 518 and the second ceramic disc 520 when the second ceramic disc 520 is in motion, e.g., rotating with the shaft 234, or stationary.

It will be appreciated that a configuration of the seal 516 shown in FIGS. 5 and 8 are non-limiting examples of the seal and other examples have been contemplated. Various types of dynamic seals may be used in place of the seal 516 without departing from the scope of the present disclosure.

As described above, when coolant flow and fluid pressure in the inner chamber 212 is uniform throughout the inner chamber 212 of the pump 202, the base 514 of the inner portion 506 of the shaft 234 may contact little to no coolant. In some examples, an insulating air pocket may form in the recess 512 surrounding the seal 516. The air pocket may further exacerbate a lack of heat exchange from the shaft 234 to the coolant, allowing the base 514 of the inner portion 506 of the shaft 234 to warm during pump operation. The seal 516, including components formed of a more flexible and less heat tolerant material than the shaft 234 of the impeller 204 or the casing 206, may become degraded after repeated exposure to high temperatures, losing a sealing efficiency at the shaft/casing interface. Degradation of the seal 516 may lead to coolant leakage out of the pump 202.

Inefficient cooling of the seal 516 may be circumvented by adapting the inner chamber 212 of the pump 202 with a set of tabs 304, as shown in FIGS. 3 and 5. The set of tabs 304 includes a first tab 306 and a second tab 308 that are differently shaped, arranged in series along a portion of the perimeter of the inner chamber 212 and spaced apart so that the first tab 306 and the second tab 308 are separated by a gap 360. For example, the set of tabs 304 may be positioned in-line in a semi-circle along the perimeter of the inner chamber 212 on an opposite side of the inner chamber from the first outlet 208 and adjacent to the second outlet 210. The first tab 306 and the second tab 308 may be curved (along the x-y plane), elongate ridges protruding upwards, with respect to the z-axis, from the bottom surface 274 of the inner chamber 212. However, the set of tabs 304 may not protrude higher than the depth 502 of inner chamber 212. A base plate 401 of the impeller 204 may be positioned above, with respect to the z-axis, the set of tabs 304 so that a bottom surface of the base plate 401, which includes a second face 440 of the impeller 204 that is opposite of the first face 260, is spaced away from the set of tabs 304 and does not contact the set of tabs 304, as shown in FIG. 4. A length 310 of the first tab 306 may be similar to a length 312 of the second tab, the lengths indicated in FIG. 3. For example, the length 310 of the first tab 306 may be within 1-5% of the length 312 of the second tab 312.

The lengths 310 and 312 of the first tab 306 and the second tab 312 may be configured based on a proximity of each tab to a first cut water 380 and a second cut water 382 of the pump 202. The first cut water 380 and the second cut water 382 may be triangular regions that decrease in height, relative to the z-axis, as the first and second cut waters 380, 382 extend away from a side wall 384 of the first outlet 208 and a side wall 386 of the second outlet 210, respectively. Coolant flow proximate to the first and second cut waters 380, 382 may be relatively slow or stagnant.

The lengths 310 and 312 of the first and second tabs 306, 312 may be defined based on radial distances from the first cut water 380. For example, a first line 388 intersecting the first cut water 380 and a center of the shaft 234 may provide an initial 0 degrees position. A first end 390 of the first tab 306 may be positioned at an angle between 5-20 degrees relative to the first line 388, if a line is drawn between the first end 390 and the center of the shaft 234. A second end 392 of the first tab 306 may similarly form an angle with respect to the first line 388 between 70-100 degrees. The length 310 of the first tab 306 may therefore have a radial distance that spans across a maximum range of 5 to 100 degrees relative to the first line 388 or extend across a portion of a circumference of the inner chamber 212 between 18-26% of the circumference.

A first end 394 of the second tab 308, spaced away from the second end 392 of the first tab 306, may be positioned at an angle between 50-80 degrees relative to the first line 388, if a line is drawn from the second end 392 of the second tab 308 to the center of the shaft 234. A second end 396 of the second tab 308 may similarly form an angle with respect to the first line 388 of between 180-210 degrees. The length 312 of the second tab 308 may therefore have a radial distance with a maximum range of 50 to 210 degrees or form a portion of the circumference of the inner chamber 212 between 28-44% of the circumference.

Regardless of the individual lengths of the first tab 306 and the second tab 308, the gap 360 may be preserved between the tabs and a total portion of the inner chamber 212 circumference spanned by the set of tabs 304, including the gap 360, may not exceed 57% of the circumference or be less than 44% of the circumference. The lengths 310, 312 of the first tab 306 and second tab 308 may be varied within the ranges described above to achieve a desired effect of flow direction within the inner chamber 212. Furthermore, in some examples, the set of tabs 304 may also be disposed in the portion of the pump 202 formed in the engine block 600 of FIG. 6. For example, the pump 202 may have two sets of tabs, a first set of tabs coupled to the casing 206 of the pump 202 and a second set of tabs coupled to the groove 620 in the engine block 600, the sets of tabs aligned along the central axis 203 and mirroring one another across the x-y plane.

The first tab 306 of the set of tabs 304 may extend around the central axis with a uniform radius, along the length 310 of the first tab 306, that is smaller than the radius 302 of the inner chamber 212. For example, the radius 302, e.g, a distance from the center of the shaft 234 to a curved outer circumferential surface, or rim 338, of the inner chamber 212 may be 50 mm. A radius 309 of the first tab 306, e.g, a distance from the center of the shaft 234 to a center of a width 322 of the first tab 306 (the width 322 shown in FIG. 3B), may be 39.5 mm along the entire length 310 of the first tab 306. In other examples, the radius of the first tab 306 may be 0.25 mm more or less than 39.5 mm.

The second tab 308 may not have a uniform radius along the length 312 of the second tab 308. Instead, the second tab 308 may have a first segment 328 and a second segment 340 with geometries that differ from one another. For example, the first segment 338 may have a radius 311, uniform along a portion of the length 312 of the second tab 308 formed of the first segment 338, that is 39.5 mm. The radius 311 may be a distance from the center of the shaft to a center of a width 326 of the first segment 338 of the second tab 308, the width 326 shown in FIG. 3C. The second segment 340 of the second tab 308, however, may have a radius 313 that is 42.75 mm. The radius 313 may be a distance from a center of a width 348 of the second segment 340, the width 348 shown in FIG. 3D, to the center of the shaft 234, and may be uniform along a portion of the length 312 of the second tab 308 that forms the second segment 340. Both the radii 311, 313, of the first segment 338 and the second segment 340, respectively, of the second tab 308 may vary by ±0.25 mm.

A height, defined along the z-axis, and a width, perpendicular to both the height and the length, of each tab of the set of tabs 304 may also have specific effects on coolant flow within the inner chamber 212. As an example, a first cross-section 314 of the first tab 306, taken along line B-B' in FIG. 3A shows that the first tab 306 has a domed upper surface 316 and inwardly curving sides 318. The first tab 306 has a height 320, defined along the z-axis, that is less than the depth 502 of the inner chamber 212. The width 322 of the first tab 306 may become narrower from a base 315 of the first tab 306 towards the upper surface 316 and may be, for example, between 1.5 to 2.5 mm wide at the base 315. The width 322 of the first tab 306 may be less than the length 310 of the first tab. For example, the length 310 may be 10 times or 15 times greater than the width 322. Furthermore, the height 320 may be equal to or greater than the width 322.

The height 320 of the first tab 306 may be greater than a height 324 of the first segment 328 of the second tab 308, shown in FIG. 3C in a second cross-section 330 of the first segment 328 of the second tab 308 taken along line C-C' shown in FIG. 3A. However, the width 322 of the first tab 306 is less than the width 326 of the first segment 338 of the second tab 308, which may be between 5.5-6.5 mm at a base 336 of the first segment.

The first segment 328 of the second tab 308 may form a portion of the length 312 of the second tab 308, such as 70% or 80% or a portion between 50-90%. The second cross-section 330 of FIG. 3C shows that an upper surface 332 of the first segment 328 is flat and sides 334 of the first segment 328 curve inwards. The width 326 of the first segment 328 of the second tab 308 may taper to narrow from the base 336 of the first segment 328 towards the upper surface 332. The length 312 of the second tab may be 10 to 15 times greater than the width 326 of the first segment 328.

The first segment 328 of the second tab 308 and the first tab 306 may be similarly spaced away from the rim 338 defining the perimeter of the bottom surface 274 of the inner chamber 212. The rim 338 extends entirely around the circumference of the inner chamber 212. Coolant may flow between the first segment 328 of the second tab 308 and the rim 338 and between the first tab 306 and the rim 338 along the entire height 324 of the first segment 328. Between the second segment 340 of the second tab 308 and the rim 338, coolant may flow along an upper portion of a height 344 of the second segment 340 but not along a lower portion of the height 344, the coolant flow being confined to a shallow channel 345 between the second segment 340 and the rim 338.

As shown in a third cross-section 342 taken along line D-D' across the second segment 340 of the second tab 308, the second segment 340 protrudes both upwards from the bottom surface 274 of the inner chamber 212, along the z-axis, and inwards along the x-y plane towards the central axis 203 of the pump 202 from the rim 338. The second segment 340 may form a step extending towards the central axis 203 from the rim 338 where the height 344 of the second segment 340 is less than the depth 502 of the inner chamber 212. An upper surface 346 of the second segment 340 may be flat and couple continuously to the rim 338 through a region that curves downwards, relative to the z-axis, and forms the shallow channel 345, at an intersection of the upper surface 346 and the rim 338. A height 347 of the curved region at the shallow channel 345 may be lower than the height 344 of the second segment 340 of the second tab 308.

The height 344 of the second segment 340 may be greater than the height 324 of the first segment 328 of the second tab 308 and greater than the height 316 of the first tab 306. The width 348 of the second segment 340 may be greater than the width 326 of the first segment 328. For example, the width 348 of the second segment 340 may be between 14-15 mm. As such, the width 348 of the second segment 340 may be a sum of the width 326 of the first segment 328 and a distance between one of the sides 334 of the first segment 328, closest to the rim 338, and the rim 338. The length 312 of the second tab 308 is greater than the width 348 of the second segment 340 of the second tab 308 by a lesser amount than the width 326 of the first segment 328, such as 8-10 times greater. An inner surface 350 of the second tab 308, extending along the entire length 312 of the second tab and including one of the sides 334 of the first segment 328 that is distal to the rim 338, may be continuous and uninterrupted across both the first segment 328 and the second segment 340.

The inner chamber 212 of the pump 202 may also have a set of protrusions 370, as shown in FIGS. 3A and 5, extending upwards, along the z-axis, from the bottom surface 274 of the inner chamber 212. The set of protrusions 370 may include a first protrusion 372 and a second protrusion 374, each protrusion having a circular geometry when viewed along the z-axis. Each protrusion may be similar in shape and size, each forming a domed structure with a height that is less than any of the heights of the set of tabs 304. The first protrusion 372 and the second protrusion 374 may each have a radius of 2 mm, for example. The set of protrusions 370 may be positioned near the first intersecting region of the first outlet 208 with the inner chamber 212, adjacent to the first cut water 380, with the first protrusion 372 closer to the first intersecting region 216 than the second protrusion 374. The first protrusion 372 may be arranged along the rim 338 of the inner chamber 212 while the second protrusion 374 may be arrange between the rim 338 and the shaft 234. As an example, the first protrusion 372 may be 47 mm away from the center of the shaft 234 and the second protrusion 374 may be 41 mm away from the center of the shaft 234.

The positioning and geometry of the set of tabs 304, the set of protrusions 370, as well as a size of the gap 360 may have a pronounced effect on pressure distribution within the inner chamber 212. A schematic diagram of a flow field 900 in a dual volute coolant pump 902 is shown in FIG. 9. In one example, the dual volute coolant pump 902 may be the pump 202 of FIGS. 2-5, adapted with a set of tabs 904 including a first tab 906 and a second tab 908, separated by a gap 940, and a set of protrusions 950. The first tab 906 has a first end 918 and a second end 919 that are similar in width and the second tab 908 has a first end 922 that is wider than a second end 923 of the second tab 908. The gap 940 is a space between adjacent edges of the first tab 906 and the second tab 908, e.g., a distance between an end of the first tab 906 proximate to the second tab 908 and an end of the second tab 908 proximate to the first tab 906. The set of tabs 904 may be a non-limiting example of the set of tabs 304 shown in FIGS. 3 and 5 and described above. Similarly, the set of protrusions 950 may be a non-limiting example of the set of protrusions 370 of FIGS. 3A and 5. A flow of coolant, as indicated by a plurality of arrows 905, may rotate counter-clockwise in the flow field 900, driven by counter-clockwise rotation of an impeller, such as the impeller 204 of FIGS. 2 and 4. Coolant may enter the pump 902 through an inlet positioned adjacent to a central region 903 of the pump 902 and aligned with a central axis of the impeller, as shown in FIG. 8, and flow outwards, towards a perimeter of an inner chamber 910 of the pump 902 due to centrifugal force.

The plurality of arrows 905 within the inner chamber 910 represents regions of highest coolant flow velocity, while regions of lower flow velocity are not indicated for brevity. Thus coolant may flow through areas without arrows but at lower velocities. The flow field 900 indicates flow along a plane co-planar with the x-y plane. The set of tabs 904 may form a semi-circle, with the gap 940 between the first tab 906 and the second tab 908, along a half of the inner chamber 910 proximate to a second outlet 914, arranged on an opposite side of the pump 902 from a first outlet 912. Coolant may exit the pump 902 through both the first outlet 912 and the second outlet 914, as indicated by arrows 901.

The plurality of arrows 905 depicted in the inner chamber 910 of the pump 902 show highest flow velocities around a perimeter of the inner chamber 910. For example, coolant may be channeled through an opening 915 between the first end 918 of the first tab 906 and a wall 926 of the pump. As the coolant flows between the first tab 906 and the wall 926, a zone 911 of high flow may form between the first tab 906 and the wall 926 of the inner chamber 910 due to confinement of coolant flow to a relatively narrow channel between the first tab 906 and the wall 926. A positioning of the first tab 906 thus creates a strong, e.g., high velocity, current along the first tab 906 with a pressure field.

The high velocity coolant flowing along the first tab 906 may come into contact with the first end 922 of the second tab 908 due to the greater width of the first end 922 of the second tab 908 than the width of the second end 919 of the first tab 906. Furthermore, a height, defined along the z-axis, of the second tab 908 may be greater than the first tab 906, enabling the first end 922 of the second tab 908 to act as a wall or barrier that diverts at least a first portion 916 of the coolant flow.

The first end 922 of the second tab 908 may force the portion of the coolant flow to turn inwards, towards the central region 903. The inwards flow forms a pressure jet 920 that drives coolant to flow across the central region 903 and merge with a high velocity flow region 913 at an intersecting region of the first outlet 912 and the inner chamber 910. The pressure jet 920 may be a stream of coolant that flows across the central region 903 of the inner chamber 910 with a similar or lesser velocity than coolant flow between the first tab 906 and the central region 903.

The arrangement of the set of protrusions 950 adjacent to the high velocity flow region 913 further encourages the pressure jet 920 to join the high velocity flow region 913 by forcing the pressure jet 920 to flow around the set of protrusions 950, e.g., to flow between the set of protrusions 950 and the wall 926 of the pump 902. The coolant exiting the pump 902 through the first outlet 912 may flow out of the pump 902 with a high flow rate.

A size of the gap 940, e.g., a distance separating the first tab 906 from the second tab 908, may influence a strength of the second jet 920. For example, narrowing the gap 940 may create a greater restriction on flow, increasing a pressure at the gap 940 and increasing flow velocity through the gap 940. Conversely, widening the gap 940 may form a more diffuse, lower pressure jet and decrease the velocity of the second jet 920. In this way, the second jet 920 may be tuned to provide a desired intensity of the second jet 920 according to a geometry of the pump components. For example, a narrower gap 920 may accommodate an inner chamber with a larger volume to ensure the pressure jet has sufficient velocity to traverse the inner chamber. As another example, a pump adapted with larger tabs with enhanced restriction on flow around the circumference of the inner chamber may have a wider gap 940.

While the first portion 919 of coolant flow at the first end 922 of the second tab 908 may be turned towards the central region 903 of the pump 902 to flow through the gap 940, a second portion 921 of the flow may continue around the first end 922 of the second tab 908, along the perimeter of the inner chamber 910. The second portion 921 of the flow may continue flowing between the second tab 908 and the wall, through an intersecting region of the second outlet 914 with the inner chamber 910. The second portion 921 of the flow may split into a third portion 907 and a fourth portion 909 at the intersecting region, the third portion 907 exiting the inner chamber 910 through the second outlet 914, where the flow rate through the second outlet 914 is less than the flow rate through the first outlet 912.

As the fourth portion 909 of the coolant flow travels along the second tab 908, a width and a height of the second tab 908 decreases. For example, a second segment 954 of the second tab 908 may be narrower and shorter than a first segment 952 of the second tab 908, as described above with reference to FIGS. 3C and 3D. The decrease in height of the second tab 908 from the first segment 952 to the second segment 954 allows a fraction of the fourth portion 909, e.g., a fifth portion 917, to flow over the second segment 954 of the second tab 908 towards the central region 903, to be entrained into the pressure jet 920 traversing the central region 903 of the inner chamber 910.

By forcing coolant to flow through narrower channels, a pressure differential across the inner chamber 910 may be generated. More specifically, a first half 928 of the inner chamber that includes the set of tabs 904, may be a high pressure zone that is higher in pressure than a low pressure zone 930 formed of an opposite, second half 930 of the inner chamber 910. The difference in pressure between the high pressure zone 928 and the low pressure zone 930 drives an overall flow direction across the inner chamber 910, as indicated by arrow 932, representing an overall direction of a current across the inner chamber 910, formed predominantly of the pressure jet 920. The pressure differential further enhances flow of coolant through the gap 940, increasing a cross-flow of coolant through the central region 903 of the inner chamber. The increased cross-flow in the central region 903, may flow across a base of a drive shaft of the pump 902, e.g., the shaft 234 of FIGS. 2-5, and 8, immediately above a seal, relative to the z-axis, sealing an interface between the shaft and a housing of the pump 902. In some examples, the coolant flow may contact at least a portion of the seal.

The cross-flow through the central region 903 may impede formation of a coolant vortex around the central region that is isolated from exchange with fresh, cooler coolant. The higher flow of coolant through the central region 903 may increase contact between a portion of an impeller shaft, such as the base 514 of the inner portion 506 of the impeller shaft 234 of FIGS. 2-5, and the coolant circulating through the pump 902. A seal, e.g., the seal 516 shown in FIGS. 3, 5, and 8, arranged at the base of the impeller shaft, within the inner chamber 910, may be convectively cooled by the cross-flow of coolant, thereby reducing thermal stress on the seal.

For example, as the coolant flows around the base of the shaft, the coolant may extract heat conducted through the shaft from a motor of the pump 902. Although the coolant may not enter the recess in the inner chamber 910 of the pump 902, positioned below the seal along the z-axis, and centered about a central axis of the pump 902, the coolant may draw heat away from the recess by absorbing heat from the portion of the shaft that the coolant contacts. The pressure jet 920 allows fresh coolant, e.g., cooler coolant, to continuously replace the coolant directly in contact with the shaft of the pump 902, thus efficiently lowering a temperature of the shaft and the seal by convective heat transfer.

A set of flow-adjusting, anti-vortex tabs may thereby modify flow within a coolant pump to enhance convective cooling of a shaft seal and mitigate thermal fatigue of the seal. Geometries of the set of tabs may be tuned to provide desired flow effects. For example, a first tab, e.g., the first tab 306 of FIGS. 3A, 3B, 5, and 906 of FIG. 9, may have a height and a length adapted to enable the first tab to form a pressure field that creates a strong coolant current in a region of the pump chamber between the first tab and a side wall of the pump. A second tab, e.g, the second tab 308 of FIGS. 3A, 3C-3D, 5, and 908 of FIG. 9 may have a first segment that is wider and taller than a second segment of the second tab. The first segment forms a wall that forces at least a portion of the strong current flow induced by the first tab to turn towards a central region of the pump chamber to flow past the shaft. A remaining portion of the flow that continues along a perimeter of the pump chamber may be divided between flowing over the second segment to join the cross-flow in the central region of the pump chamber and continuing around the perimeter of the pump chamber. The flow travelling around the perimeter of the pump chamber generates pressure as the coolant flows through a channel between the second segment of the second tab and the side wall of the pump, the second segment forming a pressure wall. The higher pressure along the second segment of the second tab enhances flow velocity towards a volute positioned opposite of the second tab, across the pump chamber, driving outflow of coolant through the volute. Thus both cooling of the shaft and coolant circulation through the pump is more efficient.

Dimensions of the set of tabs shown in FIGS. 3A-3D, 5, and 9 are non-limiting examples of the set of tabs. The relative lengths, widths, heights, and location relative to cut waters of the pump may be optimized together to provide desired effects on coolant circulation through the pump. For example, if a length of the first tab is varied, dimensions of the second tabs may be changed based on modification of the second tab and positioning of the tabs relative to the cut waters may be adjusted. If the length of the first tab is varied without corresponding adjustments to the second tab and to positioning of the tabs, desired effects of the set of tabs may not be fully realized.

A routine 1000 for generating coolant cross-flow in a dual-volute coolant pump coupled to a cooling system is shown in FIG. 10. The pump may be the pump 202 of FIGS. 2-5, formed partially from a casing and partially from an engine block, the pump including a seal arranged around a drive shaft of an impeller configured to seal an interface between the shaft and the pump housing. An inner chamber of the pump, in which the impeller and seal are disposed, includes a set of tabs around half of a circumference of the inner chamber, adjacent to a first volute, or outlet, of the pump. The pump also has a second volute, or outlet, arranged co-planar with and along an opposite side of the inner chamber from the first volute. The set of tabs protrude from a first surface of the inner chamber into a space between the first surface and a first face of the impeller and includes a first tab and a second tab that have different geometries and are spaced apart by a gap.

At 1002, the routine includes activating a device to drive rotation of the impeller. The device may be a crankshaft of the engine or an electric motor coupled to the drive shaft of the impeller. The rotation of the impeller drives motion of coolant through the cooling system, flowing coolant into the inner chamber of the pump, at 1004, through an inlet aligned with a central axis of the impeller and perpendicular to the first and second volutes. The inlet channels coolant to a second face of the impeller, the second face opposite of the first face.

At 1006, the routine includes flowing coolant around the circumference of the inner chamber, as compelled by rotation of the impeller. As coolant contacts blades of the impeller, the coolant swirls in a same direction as the impeller spins. Centrifugal force exerted on the coolant pushes the coolant outwards, away from the central axis of the impeller. As the coolant flows along the circumference, or outer perimeter of the inner chamber, the coolant flows along the first tab forming a smaller jet at a first end of the first tab and diverting at least a portion of the flow to travel towards a central region of the inner chamber. The remainder of the coolant flow continues flowing towards the second tab.

At 1008, the method includes generating a cross-flow of coolant across the inner chamber. The cross-flow of current impedes formation of a vortex within the central region of the inner chamber that may otherwise isolate coolant at the base of the impeller shaft from exchanging with new, cooler coolant. The flow of current across the central region may also at least partially mitigate formation of an air pocket within a recess of the inner chamber surface surrounding the base of the impeller shaft.

Generating the cross-flow of current includes forming a pressure jet at the gap between the first tab and the second tab at 1010. A first end of the second tab that is proximate to the first tab is wider than the first tab, creating a more pronounced obstacle in the flow path. The wider first end of the second tab causes at least a portion of the coolant flow to be diverted through the gap between the first and second tabs. Forcing the coolant to flow through the narrow opening of the gap increases a fluid pressure at the gap and forms a pressure jet. The pressure jet flows towards the central region of the inner chamber. The cross-flow of current is also formed, at 1012, by generating a pressure differential across the inner chamber. As coolant flows past the set of tabs through narrower channels formed by the set of tabs, flow is restricted, causing pressure to rise in half of the inner chamber where the set of tabs are disposed. The opposite half of the inner chamber is lower in pressure and a pressure gradient-driven coolant flow is induced, flowing from the higher pressure half of the chamber to the lower pressure half, enabling coolant exchange in the central region of the inner chamber, in contact with the seal.

In this way, a seal of a dual-volute coolant pump may be convectively cooled by coolant circulating within an inner chamber of the pump. Coolant flow may be compelled to flow around an outer perimeter of the inner chamber due to a rotating impeller of the pump. By arranging a set of anti-vortex tabs along the outer perimeter, in the path of coolant flow and along one half of the inner chamber, at least a portion of the flow may be diverted towards an impeller shaft in a central region of the inner chamber, encouraging flow of coolant into the central region of the inner chamber and across the seal. The cross-flow inhibits generation of a fluid vortex that may otherwise isolate the central region from mixing with incoming coolant. Cross-flow of coolant may be further compelled by formation of a pressure differential across the inner chamber of the pump, arising from flow restrictions imposed by the set of tabs. The cross-flow of coolant increases an amount of coolant flowing past the seal, enabling heat to be efficiently extracted from the seal, and may at least partially mitigate formation of an air pocket in a recess adjacent to the seal.

The technical effect of implementing the set of anti-vortex tabs in the dual-volute coolant pump is that a pressure differential is generated in the pump, driving the cross-flow of current across a central region where a seal is disposed. The cross-flow of current provides continuous cooling of the seal, thereby reducing degradation of the seal and a likelihood of coolant leakage from the pump.

In one embodiment, a cooling system pump includes a housing enclosing an impeller rotatable about a drive shaft, a seal sealing an interface between the drive shaft and the housing; and a first flow-adjusting tab and a second flow-adjusting tab positioned along an outer circumference of an inner chamber of the housing, the first tab spaced away from the second tab by a gap and having a different geometry than the second tab. In a first example of the pump, the first tab and the second tab have similar lengths, defined along the outer circumference of the inner chamber, and different widths and different cross-sectional profiles from one another, each width perpendicular to a respective length. A second example of the pump optionally includes the first example, and further includes, wherein the width is uniform along the length of the first tab and wherein the second tab has a first segment with a greater width than a width of a second segment of the second tab, the first segment and the second segment continuously coupled to form a single unit. A third example of the pump optionally includes one or more of the first and second examples, and further includes, a first volute coupled to a first side of the inner chamber defining a first outlet flow path of the pump and a second volute coupled to a second side of the inner chamber, opposite of the first side, defining a second outlet flow path of the pump and wherein the first volute and the second volute are aligned along a common plane perpendicular to a central axis of the impeller. A fourth example of the pump optionally includes one or more of the first through third examples, and further includes, wherein the first tab and the second tab are arranged in-line with one another along the outer circumference of the inner chamber, along a half of the outer circumference arranged adjacent to the second volute and wherein the first tab and the second tab protrude from a bottom wall of the inner chamber towards the impeller, in a direction parallel with the central axis, and extend towards an outer rim of the inner chamber in a direction perpendicular to the central axis. A fifth example of the pump optionally includes one or more of the first through fourth examples, and further includes, an inlet of the pump aligned with the central axis and configured to flow a coolant to a first face of the impeller, the first face aligned perpendicular to the central axis and arranged opposite of a second face of the impeller that is proximate to the first tab and the second tab. A sixth example of the pump optionally includes one or more of the first through fifth examples, and further includes, wherein the first tab and the second tab are positioned around the outer circumference of the inner chamber, in a region of higher velocity coolant flow, and the seal is positioned in a central region of the inner chamber, around a base of the drive shaft, in a region of lower velocity coolant flow. A seventh example of the pump optionally includes one or more of the first through sixth examples, and further includes, wherein the gap between the first tab and the second tab is narrower than a radius of the inner chamber and the gap is configured to direct coolant flow in a direction from the outer circumference of the inner chamber towards the drive shaft. An eighth example of the pump optionally includes one or more of the first through seventh examples, and further includes, wherein a first half of the inner chamber that includes the first tab and the second tab has a higher pressure than a second, opposite half of the inner chamber and wherein the pump is configured to circulate coolant from the first half to the second half across a central region of the inner chamber.

In another embodiment, a pump includes a housing defining a dual-volute chamber enclosing an impeller, a set of ridges protruding from a bottom surface of a circular central chamber of the housing, in a direction parallel with a central axis of the impeller and extending from an outer circumferential surface of the central chamber into the central chamber, the set of ridges disposed along a first half of a circumference of the central chamber adjacent to a first volute of the dual-volute chamber, and a seal arranged in the central chamber around a base of a drive shaft of the impeller. In a first example of the pump, a second volute positioned along a second half of the circumference of the inner surface, opposite of the first half and the first volute. A second example of the pump optionally includes the first example, and further includes, wherein the set of ridges includes a first ridge and a second ridge arranged serially along the first half of the circumference of the inner chamber and wherein a gap is included between the first ridge and the second ridge. A third example of the pump optionally includes one or more of the first and second examples, and further includes, wherein the first ridge has a domed upper surface and a uniform height and width along a length of the first ridge and wherein the first ridge is spaced away from a rim of the central chamber, the rim defining the circumference of the central chamber. A fourth example of the pump optionally includes one or more of the first through third examples, and further includes, wherein the second ridge has a first segment that has a greater width and a greater height than a second segment of the second ridge, the first segment and the second segment continuously coupled and sharing an uninterrupted, curved side surface and wherein the first segment forms a smaller portion of the length of the second ridge than the second segment. A fifth example of the pump optionally includes one or more of the first through fourth examples, and further includes, wherein the first segment of the second ridge has a greater height than the first ridge and the second segment of the second ridge has a lesser height than the first ridge. A sixth example of the pump optionally includes one or more of the first through fifth examples, and further includes, wherein the first segment of the second ridge intersects with a rim of the central chamber, the rim defining the circumference of the central chamber, and the second segment of the second ridge is spaced away from the rim.

In yet another embodiment, a method includes rotating an impeller of the pump via the drive shaft and drawing coolant through the pump, flowing coolant around a circumference of an inner chamber of the pump along a set of tabs configured to adjust flow through the inner chamber, and generating a cross-flow of coolant in the inner chamber including flowing coolant through a gap formed between a first tab and a second tab of the set of tabs and flowing coolant between the set of tabs and an outer rim of the inner chamber to generate a pressure gradient across the inner chamber. In a first example of the method, generating the cross-flow of coolant includes flowing coolant from the outer rim of the inner chamber towards a central region of the inner chamber. A second example of the method optionally includes the first example, and further includes, wherein flowing coolant between the set of tabs and the outer rim of the inner chamber comprises increasing a pressure in a region between the set of tabs and the outer rim by flowing coolant from the first tab to a first segment of the second tab, the first segment of the second tab having a greater width and a greater height than the first tab. A third example of the method optionally includes one or more of the first and second examples, and further includes, wherein flowing coolant through the gap between the first tab and the second tab of the set of tabs includes increasing a velocity of coolant flow by flowing the coolant through a region narrower than a width of a region between the first tab and the outer rim and flowing coolant from a zone of higher pressure at the gap towards a zone of lower pressure at a central region of the inner chamber.

In another representation a cooling system for an engine block includes a plurality of cooling channels disposed in the engine block configured to flow a coolant, a heat exchanger fluidly coupled to the plurality of cooling channels, and a dual-volute coolant pump receiving the coolant from the heat exchanger via an inlet and having a set of anti-vortex elements arranged in an inner chamber of the pump, wherein the set of anti-vortex elements are configured to induce cross-flow of coolant across a central region of the inner chamber of the pump. In a first example of the cooling system, coolant entering the dual-volute coolant pump through the inlet is lower in temperature than coolant circulating within the pump. A second example of the cooling system optionally includes the first example, and further includes, wherein a seal sealing an interface between a drive shaft and a housing of the pump is arranged in the central region of the inner chamber of the pump.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A cooling system pump, comprising:

a housing enclosing an impeller rotatable about a drive shaft;

a seal sealing an interface between the drive shaft and the housing; and a first flow-adjusting tab and a second flow-adjusting tab positioned along an outer circumference of an inner chamber of the housing, the first tab spaced away from the second tab by a gap and having a different geometry than the second tab;

wherein the gap is configured to direct coolant flow in a direction from the outer circumference of the inner chamber towards the drive shaft.

2. The pump of claim 1, wherein a length of the first tab is within 1-5% of a length of the second tab, the length defined along the outer circumference of the inner chamber, and different widths and different cross-sectional profiles from one another, each width perpendicular to a respective length.

3. The pump of claim 2, wherein the width is uniform along the length of the first tab and wherein the second tab has a first segment with a greater width than a width of a second segment of the second tab, the first segment and the second segment continuously coupled to form a single unit.

4. The pump of claim 1, further including a first volute coupled to a first side of the inner chamber defining a first outlet flow path of the pump and a second volute coupled to a second side of the inner chamber, opposite of the first side, defining a second outlet flow path of the pump and wherein the first volute and the second volute are aligned along a common plane perpendicular to a central axis of the impeller.

5. The pump of claim 4, wherein the first tab and the second tab are arranged in-line with one another along the outer circumference of the inner chamber, along a half of the outer circumference arranged adjacent to the second volute and wherein the first tab and the second tab protrude from a bottom wall of the inner chamber towards the impeller, in a direction parallel with the central axis, and extend towards an outer rim of the inner chamber in a direction perpendicular to the central axis.

6. The pump of claim 5, further comprising an inlet of the pump aligned with the central axis and configured to flow a coolant to a first face of the impeller, the first face aligned perpendicular to the central axis and arranged opposite of a second face of the impeller that is proximate to the first tab and the second tab.

7. The pump of claim 5, wherein the first tab and the second tab are positioned around the outer circumference of the inner chamber, in a region of higher velocity coolant flow, and the seal is positioned in a central region of the inner chamber, around a base of the drive shaft, in a region of lower velocity coolant flow.

8. The pump of claim 7, wherein the gap between the first tab and the second tab is narrower than a radius of the inner chamber.

9. The pump of claim 1, wherein a first half of the inner chamber that includes the first tab and the second tab has a higher pressure than a second, opposite half of the inner chamber and wherein the pump is configured to circulate coolant from the first half to the second half across a central region of the inner chamber.

10. A pump, comprising:

a housing defining a dual-volute chamber enclosing an impeller;

a seal arranged in a circular central chamber around a base of a drive shaft of the impeller; and a set of ridges protruding from a bottom surface of a circular central chamber of the housing, in a direction parallel with a central axis of the impeller and extending from an outer circumferential surface of the central chamber into the central chamber, the set of ridges disposed along a first half of a circumference of the central chamber adjacent to a first volute of the dual-volute chamber;

wherein the set of ridges includes a first ridge and a second ridge, the second ridge including a first segment that intersects with a rim of the central chamber, the rim defining the circumference of the central chamber, and a second segment spaced away from the rim.

11. The pump of claim 10, further comprising a second volute positioned along a second half of the circumference of the inner surface, opposite of the first half and the first volute.

12. The pump of claim 10, wherein the first ridge and the second ridge are arranged serially along the first half of the circumference of the inner chamber and wherein a gap is included between the first ridge and the second ridge.

13. The pump of claim 12, wherein the first ridge has a domed upper surface and a uniform height and width along a length of the first ridge and wherein the first ridge is spaced away from a rim of the central chamber, the rim defining the circumference of the central chamber.

14. The pump of claim 13, wherein the first segment of the second ridge has a greater width and a greater height than the second segment of the second ridge, the first segment and the second segment continuously coupled and sharing an uninterrupted, curved side surface and wherein the first segment forms a smaller portion of the length of the second ridge than the second segment.

15. The pump of claim 14, wherein the first segment of the second ridge has a greater height than the first ridge and the second segment of the second ridge has a lesser height than the first ridge.

16. A method for cooling a pump drive shaft seal, comprising:

rotating an impeller of a pump via a drive shaft and drawing coolant through the pump;

flowing coolant around an outer circumference of an inner chamber of the pump along a set of tabs configured to adjust flow through the inner chamber; and generating a cross-flow of coolant in the inner chamber including flowing coolant from the outer circumference towards the drive shaft through a gap formed between a first tab and a second tab of the set of tabs and flowing coolant between the set of tabs and an outer rim of the inner chamber to generate a pressure gradient across the inner chamber.

17. The method of claim 16, wherein generating the cross-flow of coolant includes flowing coolant from the outer rim of the inner chamber towards a central region of the inner chamber.

18. The method of claim 17, wherein flowing coolant between the set of tabs and the outer rim of the inner chamber comprises increasing a pressure in a region between the set of tabs and the outer rim by flowing coolant from the first tab to a first segment of the second tab, the first segment of the second tab having a greater width and a greater height than the first tab.

19. The method of claim 18, wherein flowing coolant through the gap between the first tab and the second tab of the set of tabs includes increasing a velocity of coolant flow by flowing the coolant through a region narrower than a width of a region between the first tab and the outer rim and flowing coolant from a zone of higher pressure at the gap towards a zone of lower pressure at a central region of the inner chamber.

* * * * *